US006986329B2

(12) United States Patent
Scuderi et al.

(10) Patent No.: US 6,986,329 B2
(45) Date of Patent: Jan. 17, 2006

(54) SPLIT-CYCLE ENGINE WITH DWELL PISTON MOTION

(76) Inventors: Salvatore C. Scuderi, 108 Sunset Dr., Westfield, MA (US) 01085; David P. Branyon, 9723 Braun Run, San Antonio, TX (US) 78254

( * ) Notice: Subject to any disclaimer, the term of this patent is extended or adjusted under 35 U.S.C. 154(b) by 71 days.

(21) Appl. No.: 10/895,216

(22) Filed: Jul. 20, 2004

(65) Prior Publication Data

US 2005/0016475 A1 Jan. 27, 2005

Related U.S. Application Data

(60) Provisional application No. 60/489,893, filed on Jul. 23, 2003.

(51) Int. Cl.
*F02B 33/22* (2006.01)

(52) U.S. Cl. ..... 123/70 R

(58) Field of Classification Search ..... 123/70 R, 123/70 V, 68, 52.3, 53.1, 58.8, 71 R, 316, 123/53.5, 53.2, 52.2, 55.4, 197.4
See application file for complete search history.

(56) References Cited

U.S. PATENT DOCUMENTS

| | | | |
|---|---|---|---|
| 810,347 | A | 1/1906 | Porter et al. |
| 848,029 | A | 3/1907 | Haselwander |
| 939,376 | A | 11/1909 | Appleton |
| 1,111,841 | A | 9/1914 | Koenig |
| 1,248,250 | A | 11/1917 | Bohler |
| 1,301,141 | A | 4/1919 | Leadbetter et al. |
| 1,392,359 | A | 10/1921 | Rudvist |
| 1,856,048 | A | 4/1932 | Ahrens |
| 1,969,815 | A | 8/1934 | Meyer |
| 2,091,410 | A | 8/1937 | Mallory |
| 2,091,411 | A | 8/1937 | Mallory |
| 2,091,412 | A | 8/1937 | Mallory |
| 2,091,413 | A | 8/1937 | Mallory |
| 2,154,856 | A | 4/1939 | Mallory |

(Continued)

FOREIGN PATENT DOCUMENTS

DE 1048738 * 1/1959

(Continued)

OTHER PUBLICATIONS

Search Report by Patro Information K.K. of Tokyo, Japan, dated Jun. 20, 2002, signed by Teruaki Haga, Managing Director.

(Continued)

*Primary Examiner*—Henry C. Yuen
*Assistant Examiner*—Hyder Ali

(57) ABSTRACT

An engine includes a crankshaft having a crank throw, the crankshaft rotating about a crankshaft axis. A compression piston is slidably received within a compression cylinder and operatively connected to the crankshaft such that the compression piston reciprocates through an intake stroke and a compression stroke of a four stroke cycle during a single rotation of the crankshaft. An expansion piston is slidably received within an expansion cylinder. A connecting rod is pivotally connected to the expansion piston. A mechanical linkage rotationally connects the crank throw to the connecting rod about a connecting rod/crank throw axis such that the expansion piston reciprocates through an expansion stroke and an exhaust stroke of the four stroke cycle during the same rotation of the crankshaft. A non-circular path is established by the mechanical linkage which the connecting rod/crank throw axis travels around the crankshaft axis.

20 Claims, 18 Drawing Sheets

U.S. PATENT DOCUMENTS

| | | | | |
|---|---|---|---|---|
| 2,269,948 | A | 1/1942 | Mallory | |
| 2,280,712 | A | 4/1942 | Mallory | |
| 2,957,455 | A | 10/1960 | Bonvy | |
| 2,974,541 | A | 3/1961 | Dolza | |
| 3,623,463 | A | 11/1971 | De Vries | |
| 3,774,581 | A | 11/1973 | Lundv | |
| 3,895,614 | A | 7/1975 | Bailey | |
| 4,450,754 | A | 5/1984 | Liljequist | |
| 4,628,876 | A | 12/1986 | Fujikawa et al. | |
| 4,805,571 | A | 2/1989 | Humphrey | |
| 4,945,866 | A | 8/1990 | Chabot, Jr. | |
| 4,955,328 | A | 9/1990 | Sobotowski | |
| 5,146,884 | A | 9/1992 | Merkel | |
| 5,546,897 | A | 8/1996 | Brackett | |
| 5,623,894 | A | 4/1997 | Clarke | |
| 5,711,267 | A | 1/1998 | Williams | |
| 5,799,636 | A | 9/1998 | Fish | |
| 5,950,579 | A | 9/1999 | Ott | |
| 5,992,356 | A | 11/1999 | Howell-Smith | |
| 6,058,901 | A | 5/2000 | Lee | |
| 6,202,416 | B1 | 3/2001 | Gray, Jr. | |
| 6,230,671 | B1 | 5/2001 | Achterberg | |
| 6,543,225 | B2 | 4/2003 | Scuderi | |
| 6,606,970 | B2 * | 8/2003 | Patton | 123/25 C |
| 6,609,371 | B2 | 8/2003 | Scuderi | |
| 6,722,127 | B2 | 4/2004 | Scuderi et al. | |
| 6,789,514 | B2 | 9/2004 | Suh et al. | |

FOREIGN PATENT DOCUMENTS

| | | | |
|---|---|---|---|
| DE | 25.15.271 | | 10/1976 |
| DE | 26.28.155 | | 1/1978 |
| FR | 2.416.344 | | 8/1979 |
| GB | 299.602 | | 11/1928 |
| GB | 383.866 | | 11/1932 |
| GB | 721.025 | | 12/1954 |
| JP | 51-39306 | | 4/1976 |
| JP | 51-91416 | | 8/1976 |
| JP | 54-89108 | | 7/1979 |
| JP | 56-8815 | | 2/1981 |
| JP | 56-99018 | | 5/1981 |
| JP | 56-145641 | | 11/1981 |
| JP | 57-181923 | | 11/1982 |
| JP | 60-143116 | | 9/1985 |
| JP | 60-256642 | | 12/1985 |
| JP | 62-126523 | | 8/1987 |
| JP | 63-124830 | | 5/1988 |
| JP | 5-502707 | | 5/1993 |
| JP | 5-156954 | | 6/1993 |
| JP | 6-159836 | | 6/1994 |
| JP | 8-503043 | | 4/1996 |
| JP | 8-158887 | | 6/1996 |
| JP | 8-232675 | | 9/1996 |
| JP | 8-261004 | | 10/1996 |
| JP | 2000-508403 | | 7/2000 |
| JP | 2001-12250 | | 1/2001 |
| JP | 2001-207801 | | 8/2001 |
| JP | 2002-506949 | | 3/2002 |
| SU | 1.551.880 | A1 | 3/1990 |
| WO | WO - 01.16470 | A1 | 3/2001 |

OTHER PUBLICATIONS

Thermodynamic Modeling of the Two-Cylinder Regenerative Internal Combustion Engine by Francisco Ruiz, SAE 1991 Transactions, Journal of Engines, Sec. 3, vol. 100, p. 512-529.

Standard Search Report, No. RS 108446 US by the European Patent Office, dated May 23, 2003.

* cited by examiner

Cylinder Pressures vs. Crank Angle-Baseline and Dwell Concept Engines

SPLIT-CYCLE ENGINE WITH DWELL PISTON MOTION

CROSS REFERENCE TO RELATED APPLICATIONS

This application claims the benefit of U.S. Provisional Application Ser. No. 60/489,893, filed on Jul. 23, 2003, titled Dwell Piston Motion for Split-Cycle Engine, which is herein incorporated by reference in its entirety.

FIELD OF THE INVENTION

The present invention relates to internal combustion engines. More specifically, the present invention relates to a split-cycle engine having a pair of pistons in which one piston is used for the intake and compression stokes and another piston is used for the expansion (or power) and exhaust strokes, with each of the four strokes being completed in one revolution of the crankshaft. A mechanical linkage operatively connecting the expansion piston to the crankshaft provides a period of much slower piston downward motion during a portion of the period of combustion, relative to the downward motion of the same piston having a connecting rod pivotally connected to the crankshaft via fixed pin connection.

BACKGROUND OF THE INVENTION

Internal combustion engines are any of a group of devices in which the reactants of combustion, e.g., oxidizer and fuel, and the products of combustion serve as the working fluids of the engine. The basic components of an internal combustion engine are well known in the art and include the engine block, cylinder head, cylinders, pistons, valves, crankshaft and camshaft. The cylinder heads, cylinders and tops of the pistons typically form combustion chambers into which fuel and oxidizer (e.g., air) is introduced and combustion takes place. Such an engine gains its energy from the heat released during the combustion of the non-reacted working fluids, e.g., the oxidizer-fuel mixture. This process occurs within the engine and is part of the thermodynamic cycle of the device. In all internal combustion engines, useful work is generated from the hot, gaseous products of combustion acting directly on moving surfaces of the engine, such as the top or crown of a piston. Generally, reciprocating motion of the pistons is transferred to rotary motion of a crankshaft via connecting rods.

Internal combustion (IC) engines can be categorized into spark ignition (SI) and compression ignition (CI) engines. SI engines, i.e. typical gasoline engines, use a spark to ignite the air/fuel mixture, while the heat of compression ignites the air/fuel mixture in CI engines, i.e., typically diesel engines.

The most common internal-combustion engine is the four-stroke cycle engine, a concept whose basic design has not changed for more than 100 years. This is because of its simplicity and outstanding performance as a prime mover in the ground transportation and other industries. In a four-stroke cycle engine, power is recovered from the combustion process in four separate piston movements (strokes) of a single piston. Accordingly, a four stroke cycle engine is defined herein to be an engine which requires four complete strokes of one of more pistons for every expansion (or power) stroke, i.e. for every stroke that delivers power to a crankshaft.

Referring to FIGS. 1–4, an exemplary embodiment of a prior art conventional four stroke cycle internal combustion engine is shown at 10. The engine 10 includes an engine block 12 having the cylinder 14 extending therethrough. The cylinder 14 is sized to receive the reciprocating piston 16 therein. Attached to the top of the cylinder 14 is the cylinder head 18, which includes an inlet valve 20 and an outlet valve 22. The bottom of the cylinder head 18, cylinder 14 and top (or crown 24) of the piston 16 form a combustion chamber 26. On the inlet stroke (FIG. 1), an air/fuel mixture is introduced into the combustion chamber 26 through an intake passage 28 and the inlet valve 20, wherein the mixture is ignited via spark plug 30. The products of combustion are later exhausted through outlet valve 22 and outlet passage 32 on the exhaust stroke (FIG. 4). A connecting rod 34 is pivotally attached at its top distal end 36 to the piston 16. A crankshaft 38 includes a mechanical offset portion called the crankshaft throw 40, which is pivotally attached to the bottom distal end 42 of connecting rod 34. The mechanical linkage of the connecting rod 34 to the piston 16 and crankshaft throw 40 serves to convert the reciprocating motion (as indicated by arrow 44) of the piston 16 to the rotary motion (as indicated by arrow 46) of the crankshaft 38. The crankshaft 38 is mechanically linked (not shown) to an inlet camshaft 48 and an outlet camshaft 50, which precisely control the opening and closing of the inlet valve 20 and outlet valve 22 respectively. The cylinder 14 has a centerline (piston-cylinder axis) 52, which is also the centerline of reciprocation of the piston 16. The crankshaft 38 has a center of rotation (crankshaft axis) 54.

Referring to FIG. 1, with the inlet valve 20 open, the piston 16 first descends (as indicated by the direction of arrow 44) on the intake stroke. A predetermined mass of a flammable mixture of fuel (e.g., gasoline vapor) and air is drawn into the combustion chamber 26 by the partial vacuum thus created. The piston continues to descend until it reaches its bottom dead center (BDC), i.e., the point at which the piston is farthest from the cylinder head 18.

Referring to FIG. 2, with both the inlet 20 and outlet 22 valves closed, the mixture is compressed as the piston 16 ascends (as indicated by the direction of arrow 44) on the compression stroke. As the end of the stroke approaches top dead center (TDC), i.e., the point at which the piston 16 is closest to the cylinder head 18, the volume of the mixture is compressed in this embodiment to one eighth of its initial volume (due to an 8 to 1 Compression Ratio). As the piston approaches TDC, an electric spark is generated across the spark plug (30) gap, which initiates combustion.

Referring to FIG. 3, the power stroke follows with both valves 20 and 22 still closed. The piston 16 is driven downward (as indicated by arrow 44) toward bottom dead center (BDC), due to the expansion of the burning gasses pressing on the crown 24 of the piston 16. The beginning of combustion in conventional engine 10 generally occurs slightly before piston 16 reaches TDC in order to enhance efficiency. When piston 16 reaches TDC, there is a significant clearance volume 60 between the bottom of the cylinder head 18 and the crown 24 of the piston 16.

Referring to FIG. 4, during the exhaust stroke, the ascending piston 16 forces the spent products of combustion through the open outlet (or exhaust) valve 22. The cycle then repeats itself. For this prior art four stroke cycle engine 10, four strokes of each piston 16, i.e. inlet, compression, expansion and exhaust, and two revolutions of the crankshaft 38 are required to complete a cycle, i.e. to provide one power stroke.

Problematically, the overall thermodynamic efficiency of the typical four stroke engine 10 is only about one third (⅓). That is, roughly ⅓ of the fuel energy is delivered to the crankshaft as useful work, ⅓ is lost in waste heat, and ⅓ is lost out of the exhaust.

Referring to FIG. 5, an alternative to the above described conventional four stroke engine is a split-cycle four stroke engine. The split-cycle engine is disclosed generally in U.S. Pat. No. 6,543,225 to Scuderi, titled Split Four Stroke Internal Combustion Engine, filed on Jul. 20, 2001, which is herein incorporated by reference in its entirety.

An exemplary embodiment of the split-cycle engine concept is shown generally at 70. The split-cycle engine 70 replaces two adjacent cylinders of a conventional four-stroke engine with a combination of one compression cylinder 72 and one expansion cylinder 74. These two cylinders 72, 74 perform their respective functions once per crankshaft 76 revolution. The intake charge is drawn into the compression cylinder 72 through typical poppet-style valves 78. The compression cylinder piston 73 pressurizes the charge and drives the charge through the crossover passage 80, which acts as the intake port for the expansion cylinder 74. A check valve 82 at the inlet is used to prevent reverse flow from the crossover passage 80. Valve(s) 84, at the outlet of the crossover passage 80, control the flow of the pressurized intake charge into the expansion cylinder 74. Spark plug 86 is ignited soon after the intake charge enters the expansion cylinder 74, and the resulting combustion drives the expansion cylinder piston 75 down. Exhaust gases are pumped out of the expansion cylinder through poppet valves 88.

With the split-cycle engine concept, the geometric engine parameters (i.e., bore, stroke, connecting rod length, compression ratio, etc.) of the compression and expansion cylinders are generally independent from one another. For example, the crank throws 90, 92 for each cylinder may have different radii and be phased apart from one another with top dead center (TDC) of the expansion cylinder piston 75 occurring prior to TDC of the compression cylinder piston 73. This independence enables the split-cycle engine to potentially achieve higher efficiency levels than the more typical four stroke engines previously described herein.

However, there are many geometric parameters and combinations of parameters in the split-cycle engine. Therefore, further optimization of these parameters is necessary to maximize the performance and efficiency of the engine.

SUMMARY OF THE INVENTION

The present invention offers advantages and alternatives over the prior art by providing a split cycle engine with a mechanical linkage operatively connecting an expansion piston to a crankshaft to provide a period of much slower piston downward motion, or dwell, relative to the downward motion of the same piston having a connecting rod pivotally connected to the crankshaft via fixed pin connection. This dwell motion results in higher expansion cylinder peak pressure during combustion without increasing expansion cylinder expansion ratio or compression cylinder peak pressure. Accordingly the dwell model split cycle engine is expected to provide enhanced thermal efficiency gains.

These and other advantages are accomplished in an exemplary embodiment of the invention by providing an engine, which includes a crankshaft having a crank throw, the crankshaft rotating about a crankshaft axis. A compression piston is slidably received within a compression cylinder and operatively connected to the crankshaft such that the compression piston reciprocates through an intake stroke and a compression stroke of a four stroke cycle during a single rotation of the crankshaft. An expansion piston is slidably received within an expansion cylinder. A connecting rod is pivotally connected to the expansion piston. A mechanical linkage rotationally connects the crank throw to the connecting rod about a connecting rod/crank throw axis such that the expansion piston reciprocates through an expansion stroke and an exhaust stroke of the four stroke cycle during the same rotation of the crankshaft. A path is established by the mechanical linkage which the connecting rod/crank throw axis travels around the crankshaft axis. The distance between the connecting rod/crank throw axis and crankshaft axis at any point in the path defines an effective crank throw radius. The path includes a first transition region from a first effective crank throw radius to a second effective crank throw radius through which the connecting rod/crank throw axis passes during at least a portion of a combustion event in the expansion cylinder.

In an alternative exemplary embodiment of the invention, the path begins a predetermined number of degrees CA past top dead center, and the first effective crank throw radius is smaller than the second effective crank throw radius.

Another alternative exemplary embodiment of the invention provides an engine, which includes a crankshaft having a crank throw, the crank throw having a slot disposed therein, the crankshaft rotating about a crankshaft axis. A compression piston is slidably received within a compression cylinder and operatively connected to the crankshaft such that the compression piston reciprocates through an intake stroke and a compression stroke of a four stroke cycle during a single rotation of the crankshaft. An expansion piston is slidably received within an expansion cylinder. A connecting rod is pivotally connected to the expansion piston. A crank pin rotationally connects the crank throw to the connecting rod about a connecting rod/crank throw axis to allow the expansion piston to reciprocate through an expansion stroke and an exhaust stroke of the four stroke cycle during the same rotation of the crankshaft. The crank pin is slidably captured by the slot in the crank throw to allow radial movement of the crank pin relative to the crankshaft. A template is attached to a stationary portion of the engine. The template includes a crank pin track into which the crank pin extends. The crank pin track movably captures the crankpin such that the connecting rod/crank throw axis is guided through a path about the crankshaft axis.

DETAILED DESCRIPTION

I. Overview

Figure 2:
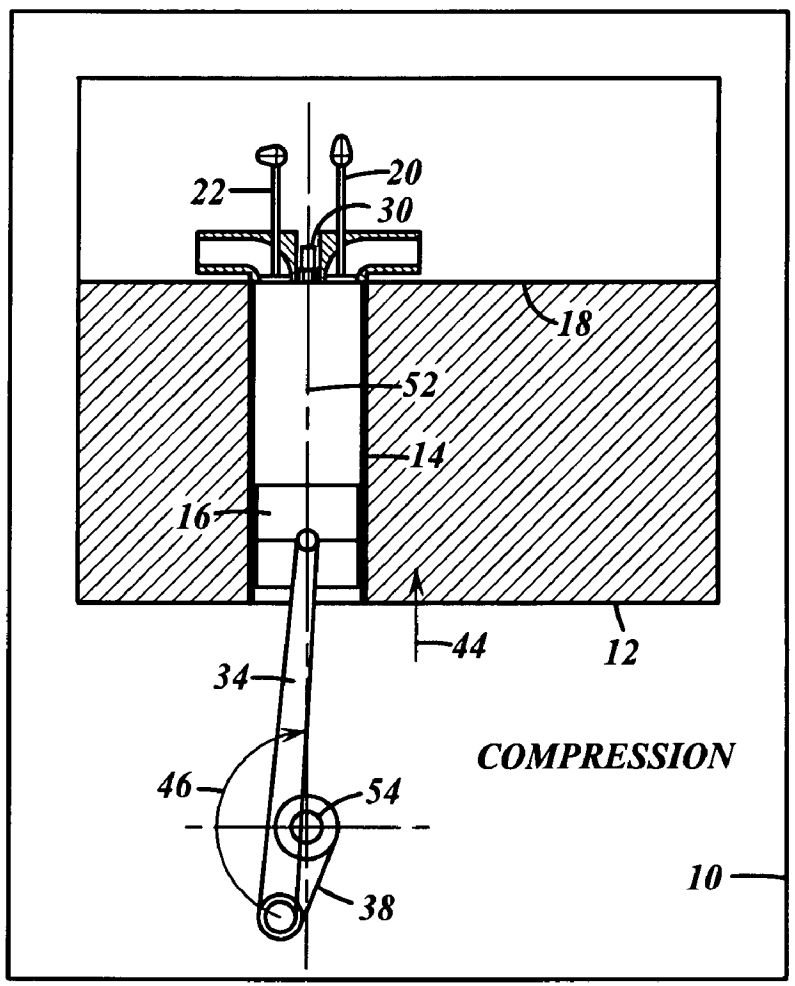
FIG. 2 PRIOR ART
FIG. 2 is a schematic diagram of the prior art engine of FIG. 1 during the compression stroke.
Figure 1:
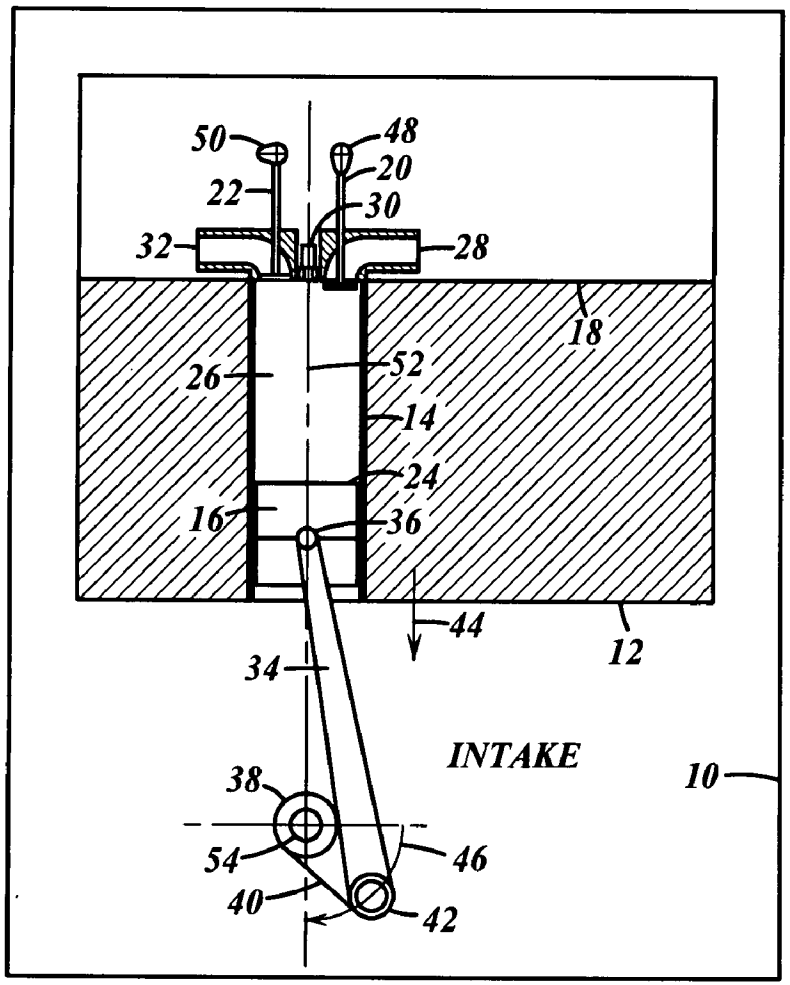
FIG. 1 PRIOR ART
FIG. 1 is a schematic diagram of a prior art conventional four stroke internal combustion engine during the intake stroke.
Figure 4:
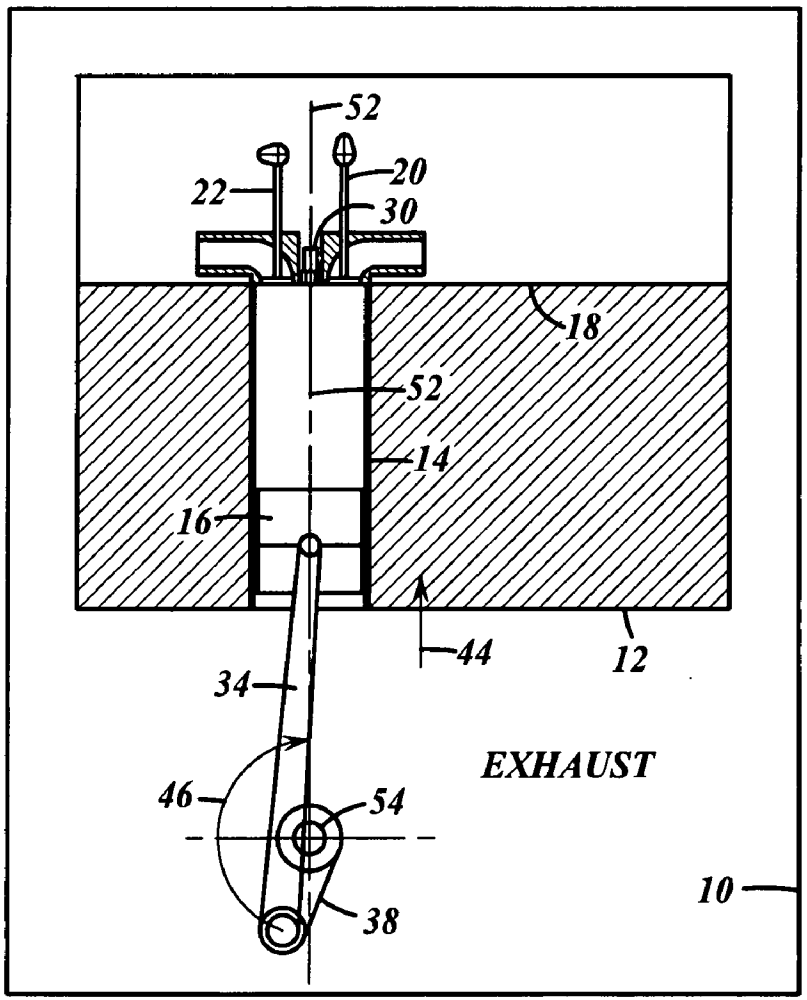
FIG. 4 PRIOR ART
FIG. 4 is a schematic diagram of the prior art engine of FIG. 1 during the exhaust stroke.
Figure 3:
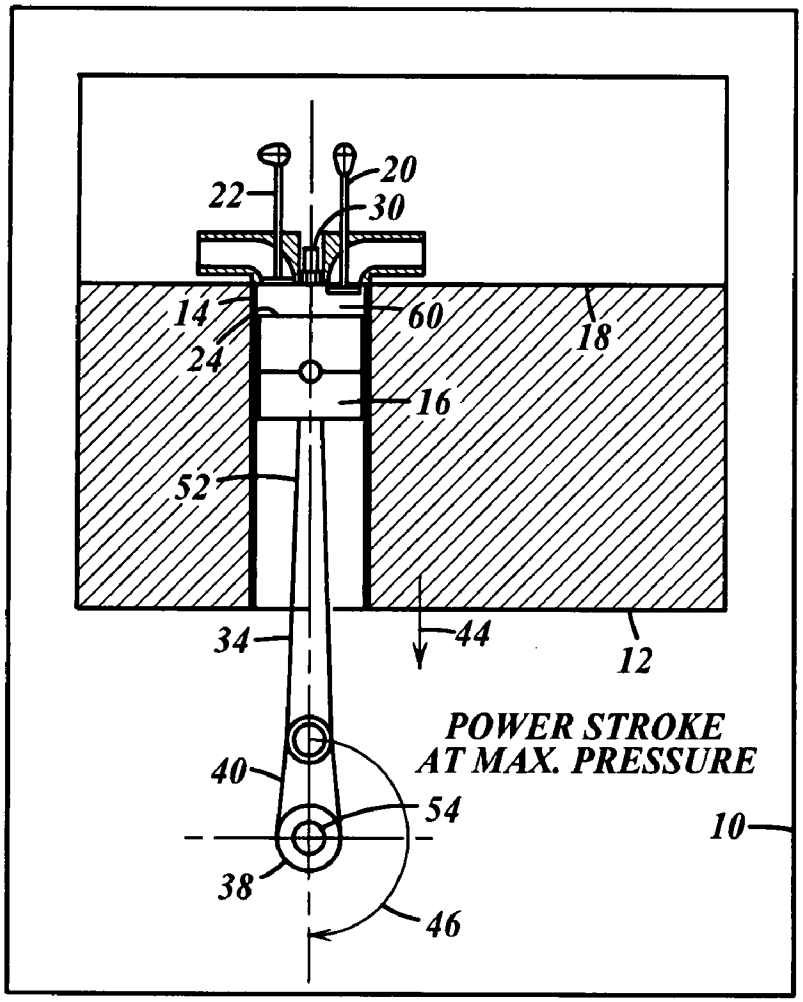
FIG. 3 PRIOR ART
FIG. 3 is a schematic diagram of the prior art engine of FIG. 1 during the expansion stroke.
Figure 5:
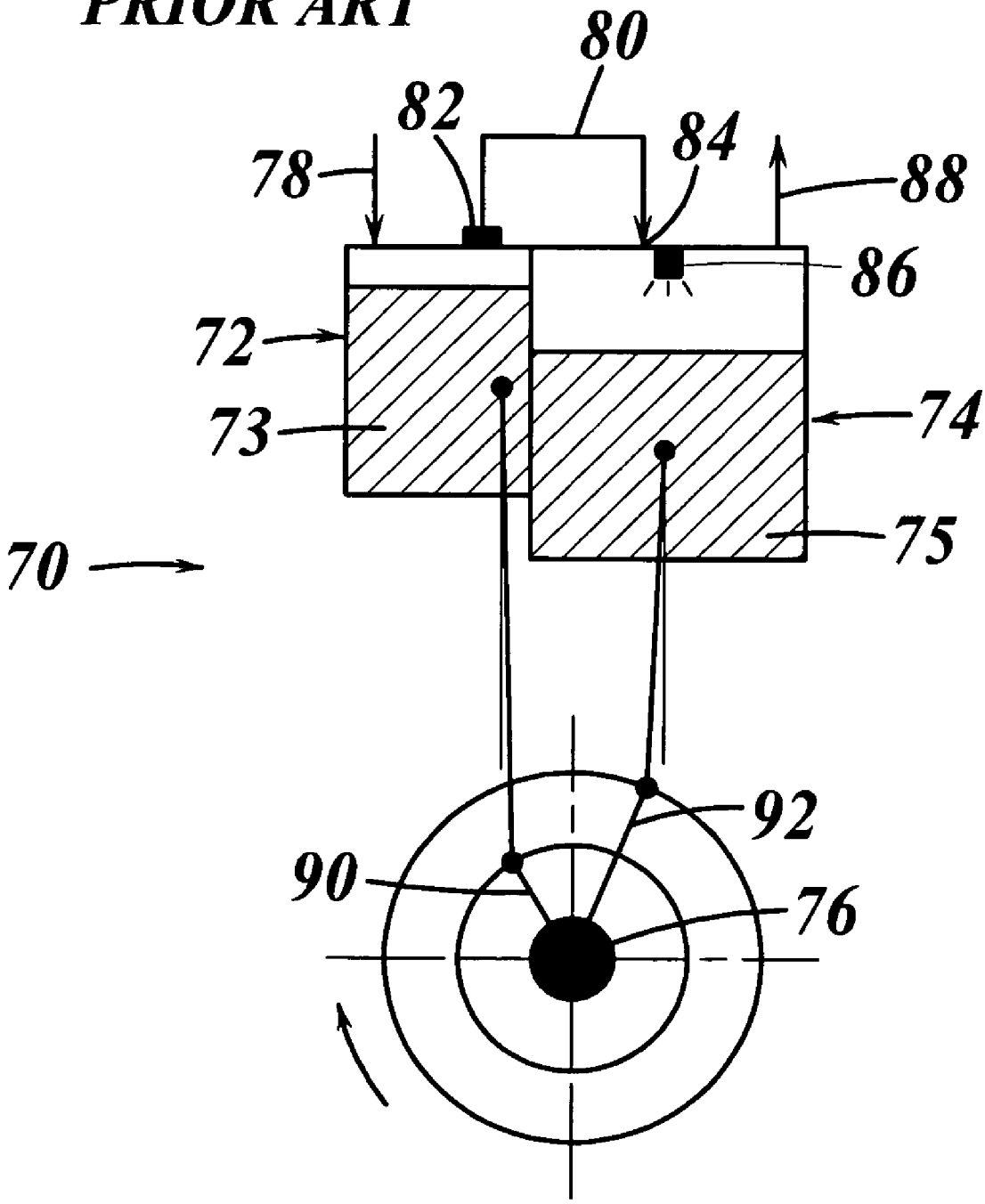
FIG. 5 PRIOR ART
FIG. 5 is a schematic diagram of a prior art split-cycle four stroke internal combustion engine.

The Scuderi Group commissioned the Southwest Research Institute® (SwRI®) of San Antonio, Tex. to perform a pair of computerized studies. The first study involved constructing a computerized model that represented various embodiments of a split-cycle engine, which was compared to a computerized model of a conventional internal combustion engine having the same trapped mass per cycle. The first study's final report (SwRI® Project No. 03.05932, dated Jun. 24, 2003, titled "Evaluation Of Split-Cycle Four-Stroke Engine Concept") is herein incorporated by reference in its entirety. The first study resulted in the U.S. patent application Ser. No. 10/864,748, filed on Jun. 9, 2004, titled Split-Cycle Four Stroke Engine to Branyon et al., which is also incorporated herein by reference. The first study identified specific parameters (e.g., compression ratio, expansion ratio, crossover valve duration, phase angle, and overlap between the crossover valve event and the combustion event), which when applied in the proper configuration, have a significant influence on the efficiency of the split-cycle engine.

The second computerized study compared a model of the split-cycle engine with parameters optimized by the first study, i.e., the baseline model, to a split-cycle engine having the same optimized parameters plus a unique piston motion, i.e., the dwell model. This dwell model was intended to represent a simplified motion attainable by mechanical devices such as those represented in this patent. The dwell model showed indicated thermal efficiency gains of 4.4 percent over the baseline model. (Frictional effects were not considered in this study.) The second study's final report (SwRI® Project No. 03.05932, dated Jul. 11, 2003, titled "Evaluation Of Dwell Piston Motion For Split-Cycle Four-Stroke Engine Concept, Phase 801") is herein incorporated by reference in its entirety and forms the basis of the present invention.

(In this report, efficiency gains stated in terms of "percent" (or %) indicate a delta percent type of value, or change in efficiency divided by original efficiency. Efficiency gains stated in terms of "percentage points" (or "points") represent actual changes in the thermal efficiency by that amount, or simply the change in thermal efficiency from one configuration to the other. For a base thermal efficiency of 30%, an increase to 33% thermal efficiency would be 3 points or 10% increase.)

The basic thermodynamic difference between the baseline model and the dwell model is in the piston motion, which is no longer confined to a slider-crank mechanism's motion. This motion was intended to represent that which might be achievable via linkages between the connecting rod and crank throw of the expansion piston. In the baseline model, the motion represents a crank throw which is pivotally connected to the connecting rod (i.e., the connecting rod/crank throw linkage) via standard fixed crank pin, where the crank throw radius (i.e., the distance between the connecting rod/crank throw axis and the crankshaft axis) is substantially constant. The motion of the dwell model requires a different connection between the connecting rod and the crank throw to obtain the unique motion profile. In other words, the crank pin would be replaced by a mechanical linkage, which enables the effective crank throw radius to transition from a first smaller radius to a second larger radius after the crank throw rotates a predetermined number of crank angle degrees past top dead center (TDC). The piston motion in the dwell model provides a period of much slower expansion piston downward motion during a portion of a period of combustion (i.e., the combustion event), relative to the downward motion of the expansion piston in the baseline model.

By slowing the piston motion down, the cylinder pressure is given more time to build up during the combustion event. This produces higher power cylinder peak pressure without increasing power cylinder expansion ratio or compression cylinder peak pressure. Accordingly, the overall thermal efficiency of the dwell model split-cycle engine is increased significantly, e.g., approximately 4%.

II. Glossary

The following glossary of acronyms and definitions of terms used herein is provided for reference:

Air/Fuel Ratio: proportion of air to fuel in the intake charge.

Bottom Dead Center (BDC): the piston's farthest position from the cylinder head, resulting in the largest combustion chamber volume of the cycle.

Crank Angle (CA): the angle of rotation of the crankshaft throw, typically referred to its position when aligned with the cylinder bore.

Crank Pin (or Rod Journal): The part of the crankshaft that orbits the crankshaft centerline onto which the bottom of the connecting rod attaches. In the dwell model, this may actually be a part of the connecting rod instead of the crankshaft.

Crankshaft Journal: is the part of a rotating crankshaft that turns in a bearing.

Crank Throw—baseline model: The webs and the crankpin of the crankshaft, the crankpin supporting the lower end of the connecting rod Crank Throw (or Crank Webs)-dwell model: In the dwell model, since the webs and crankpin are separate pieces, references herein to the crankshaft throw indicate the webs.

Combustion Duration: defined for this text as the crank angle interval between the 10% and 90% points from the start of the combustion event.

Combustion Event: the process of combusting fuel, typically in the expansion chamber of an engine.

Compression Ratio: ratio of compression cylinder volume at BDC to that at TDC

Crossover Valve Closing (XVC)

Crossover Valve Opening (XVO)

Cylinder Offset: is the linear distance between a bore's centerline and the crankshaft axis.

Displacement Volume: is defined as the volume that the piston displaces from BDC to TDC. Mathematically, if the stroke is defined as the distance from BDC to TDC, then the displacement volume is equal to $\pi/4$ *bore$^2$*stroke.

Effective Crank Throw Radius: the instantaneous distance between the axis of rotation of the crank throw (the connecting rod/crank throw axis) and the crank shaft axis. In the baseline model engine 100, the effective crank throw radius for the expansion piston is substantially constant, in the dwell model engine, the effective crank throw radius is variable for the expansion piston.

Exhaust Valve Closing (EVC)

Exhaust Valve Opening (EVO)

Expansion Ratio: is the equivalent term to Compression Ratio, but for the expansion cylinder. It is the ratio of cylinder volume at BDC to the cylinder volume at TDC.

Indicated Power: the power output as delivered to the top of the piston, before friction losses are accounted for.

Indicated Mean Effective Pressure (IMEP): the integration of the area inside the P-dV curve, which also equals the indicated engine torque divided by displacement volume. In fact, all indicated torque and power values are derivatives of this parameter. This value also represents the constant pressure level through the expansion stroke that would provide the same engine output as the actual pressure curve. Can be specified as net indicated (NIMEP) or gross indicated (GIMEP) although when not fully specified, NIMEP is assumed.

Indicated Thermal Efficiency (ITE): ratio of indicated power output to fuel energy input rate.

Indicated Torque: the torque output as delivered to the top of the piston, before friction losses are accounted for.

Intake Valve Closing (IVC)

Intake Valve Opening (IVO)

Peak Cylinder Pressure (PCP): the maximum pressure achieved inside the combustion chamber during the engine cycle.

Spark-Ignited (SI): refers to an engine in which the combustion event is initiated by an electrical spark inside the combustion chamber.

Top Dead Center (TDC): the closest position to the cylinder head that the piston reaches throughout the cycle, providing the lowest combustion chamber volume.

TDC Phasing (also referred to herein as the phase angle between the compression and expansion cylinders (see item 172 of FIG. 6)): is the rotational offset, in degrees, between the crank throw for the two cylinders. A zero degree offset would mean that the crank throws were co-linear, while a 180° offset would mean that they were on opposite sides of the crankshaft (i.e. one pin at the top while the other is at the bottom).

Valve Duration (or Valve Event Duration): the crank angle interval between a valve opening and a valve closing.

Valve Event: the process of opening and closing a valve to perform a task.

III. Embodiments Of The Dwell Model Split-Cycle Engine Resulting From The Second Computerized Study Referring to FIGS. 6A and B, exemplary embodiments of the baseline model and dwell model split cycle engines in accordance with the present invention are shown generally at 100 and 101 respectively. Both engines 100 and 101 include an engine block 102 having an expansion (or power) cylinder 104 and a compression cylinder 106 extending therethrough. A crankshaft 108 is pivotally connected for rotation about a crankshaft axis 110 (extending perpendicular to the plane of the paper).

The engine block 102 is the main structural member of the engines 100 and 101 and extends upward from the crankshaft 108 to the junction with a cylinder head 112. The engine block 102 serves as the structural framework of the engines 100 and 101, and typically carries the mounting pad by which the engines are supported in the chassis (not shown). The engine block 102 is generally a casting with appropriate machined surfaces and threaded holes for attaching the cylinder head 112 and other units of the engines 100 and 101.

The cylinders 104 and 106 are openings of generally circular cross section, that extend through the upper portion of the engine block 102. The diameter of the cylinders 104 and 106 is known as the bore. The internal walls of cylinders 104 and 106 are bored and honed to form smooth, accurate bearing surfaces sized to receive a first expansion (or power) piston 114, and a second compression piston 116 respectively.

The expansion piston 114 reciprocates along a first expansion piston-cylinder axis 113, and the compression piston 116 reciprocates along a second compression piston-cylinder axis 115. In these embodiments, the expansion and compression cylinders 104 and 106 are offset relative to crankshaft axis 110. That is, the first and second piston-cylinder axes 113 and 115 pass on opposing sides of the crankshaft axis 110 without intersecting the crankshaft axis 110. However, one skilled in the art will recognize that split-cycle engines without offset piston-cylinder axes are also within the scope of this invention.

The pistons 114 and 116 are typically cylindrical castings or forgings of iron, steel or aluminum alloy. The upper closed ends, i.e., tops, of the power and compression pistons 114 and 116 are the first and second crowns 118 and 120 respectively. The outer surfaces of the pistons 114, 116 are generally machined to fit the cylinder bore closely and are typically grooved to receive piston rings (not shown) that seal the gap between the pistons and the cylinder walls.

The cylinder head 112 includes a gas crossover passage 122 interconnecting the expansion and compression cylinders 104 and 106. The crossover passage includes an inlet check valve 124 disposed in an end portion of the crossover passage 122 proximate the compression cylinder 106. A poppet type, outlet crossover valve 126 is also disposed in an opposing end portion of the crossover passage 122 proximate the top of the expansion cylinder 104. The check valve 124 and crossover valve 126 define a pressure chamber 128 there between. The check valve 124 permits the one way flow of compressed gas from the compression cylinder 106 to the pressure chamber 128. The crossover valve 126 permits the flow of compressed gas from the pressure chamber 128 to the expansion cylinder 104. Though check and poppet type valves are described as the inlet check and the outlet crossover valves 124 and 126 respectively, any valve design appropriate for the application may be used instead, e.g., the inlet valve 124 may also be of the poppet type.

The cylinder head 112 also includes an intake valve 130 of the poppet type disposed over the top of the compression cylinder 106, and an exhaust valve 132 of the poppet type disposed over the top to the expansion cylinder 104. Poppet valves 126, 130 and 132 typically have a metal shaft (or stem) 134 with a disk 136 at one end fitted to block the valve opening. The other end of the shafts 134 of poppet valves 130, 126 and 132 are mechanically linked to camshafts 138, 140 and 142 respectively. The camshafts 138, 140 and 142 are typically a round rod with generally oval shaped lobes located inside the engine block 102 or in the cylinder head 112.

The camshafts 138, 140 and 142 are mechanically connected to the crankshaft 108, typically through a gear wheel, belt or chain links (not shown). When the crankshaft 108 forces the camshafts 138, 140 and 142 to turn, the lobes on the camshafts 138, 140 and 142 cause the valves 130, 126 and 132 to open and close at precise moments in the engine's cycle.

The crown 120 of compression piston 116, the walls of compression cylinder 106 and the cylinder head 112 form a compression chamber 144 for the compression cylinder 106. The crown 118 of expansion piston 114, the walls of expansion cylinder 104 and the cylinder head 112 form a separate combustion chamber 146 for the expansion cylinder 104. A spark plug 148 is disposed in the cylinder head 112 over the expansion cylinder 104 and is controlled by a control device (not shown), which precisely times the ignition of the compressed air gas mixture in the combustion chamber 146.

The construction of the baseline model engine 100 and the dwell model engine 101 differ thermodynamically in the motion of the expansion piston. This motion was intended to represent that which might be achievable via linkages between the connecting rod and crank throw of the expansion piston such as that discussed herein. Accordingly, the connecting rod/crank throw linkages for each engine 100 and 101 will be discussed separately.

Figure 6A:
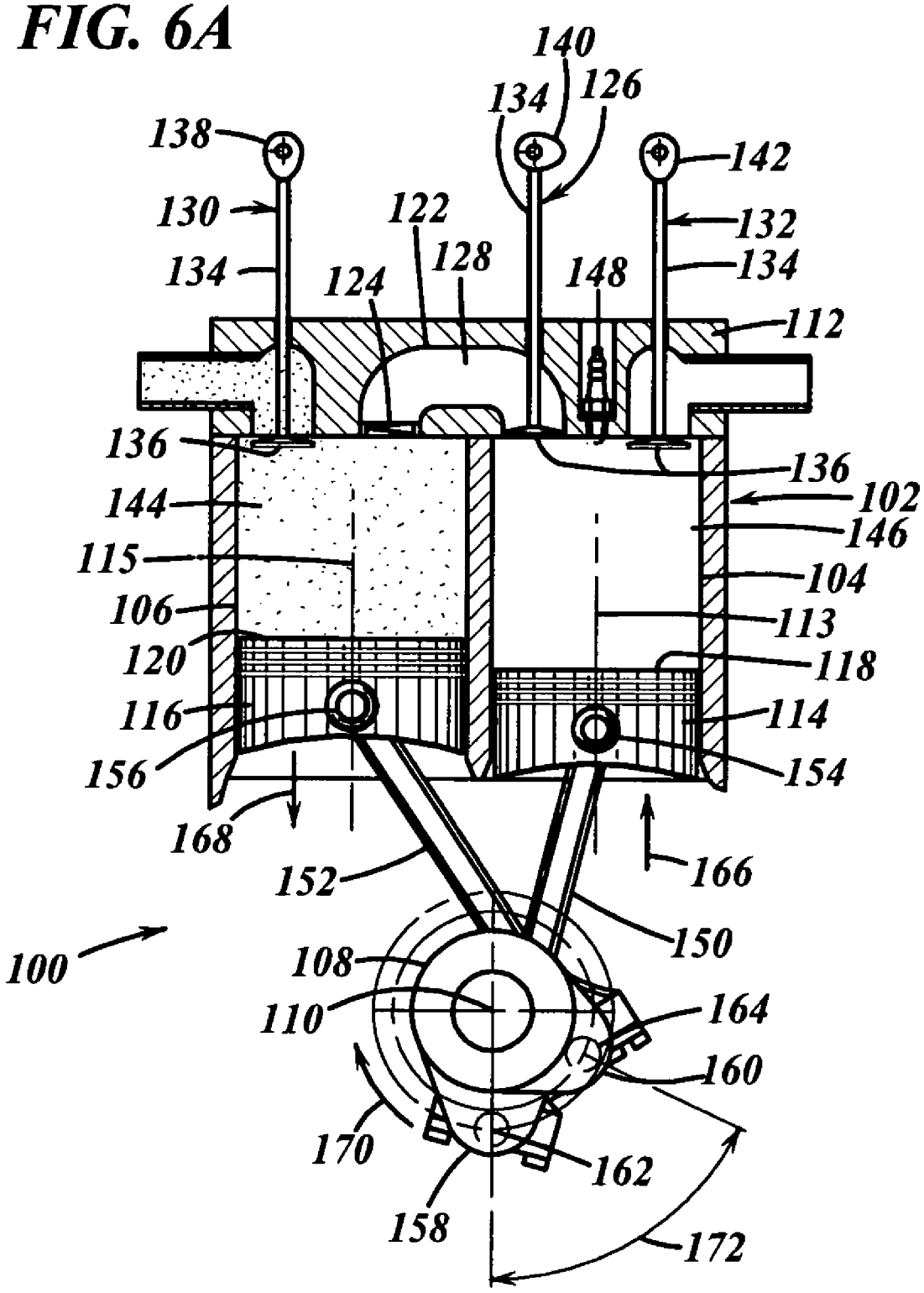
FIG. 6A is a schematic diagram of an exemplary embodiment of a baseline model split-cycle four stroke internal combustion engine in accordance with the present invention during the intake stroke.

Referring to FIG. 6A, the baseline model split-cycle engine 100 includes first expansion and second compression connecting rods 150 and 152, which are pivotally attached at their top ends via piston pins 154 and 156 to the power and compression pistons 114 and 116 respectively. The crankshaft 108 includes a pair of mechanically offset portions called the first expansion and second compression crank throws 158 and 160, which are pivotally attached to the bottom opposing ends of the connecting rods 150, 152 via crank pins 162 and 164 respectively. The mechanical linkages of the connecting rods 150 and 152 to the pistons 114, 116 and crankshaft throws 158, 160 serve to convert the reciprocating motion of the pistons (as indicated by directional arrow 166 for the expansion piston 114, and directional arrow 168 for the compression piston 116) to the rotary motion (as indicated by directional arrow 170) of the crankshaft 108.

It is important to note that, contrary to the dwell model engine 101, the crank throw radius for both the compression piston 116 and expansion piston 114 in the baseline model engine 100, i.e., the center to center distance between the crank pins 162, 164 and the crankshaft axis 110, remains substantially constant. Accordingly, the path that the crank pins 162 and 164 travel around the crankshaft axis 110 in the baseline engine 100 is substantially circular.

Figure 6B:
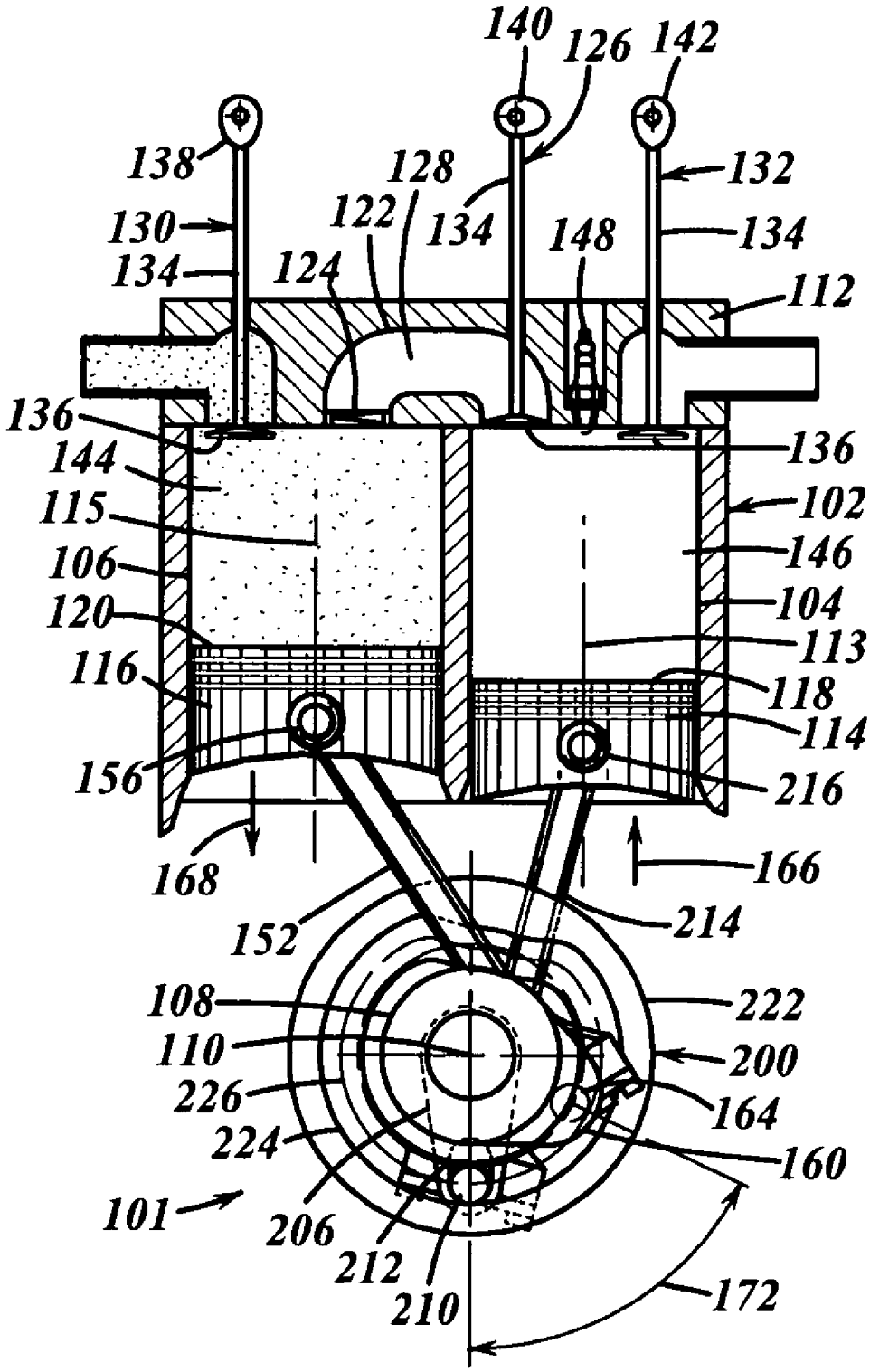
FIG. 6B is a schematic diagram of an exemplary embodiment of a dwell model split-cycle four stroke internal combustion engine in accordance with the present invention during the intake stroke

Referring to FIG. 6B, the connecting rod/crank throw linkage of the compression piston 116 to the crankshaft 108 in the dwell model split-cycle engine 101 is identical to that of the baseline engine 100. Accordingly, the reference numbers remain the same for like elements in the two engines 100 and 101. That is, the dwell engine 101 includes a compression connecting rod 152, which is pivotally attached at its top end via compression piston pin 156 to the compression piston 116. The crankshaft 108 has a compression crank throw 160, which is pivotally attached to the bottom opposing end of the compression connecting rod 152 via compression crank pin 164. Accordingly, the path that the crank pin 164 travels around the crankshaft axis 110 in the dwell engine 101 is substantially circular.

Figure 7A:
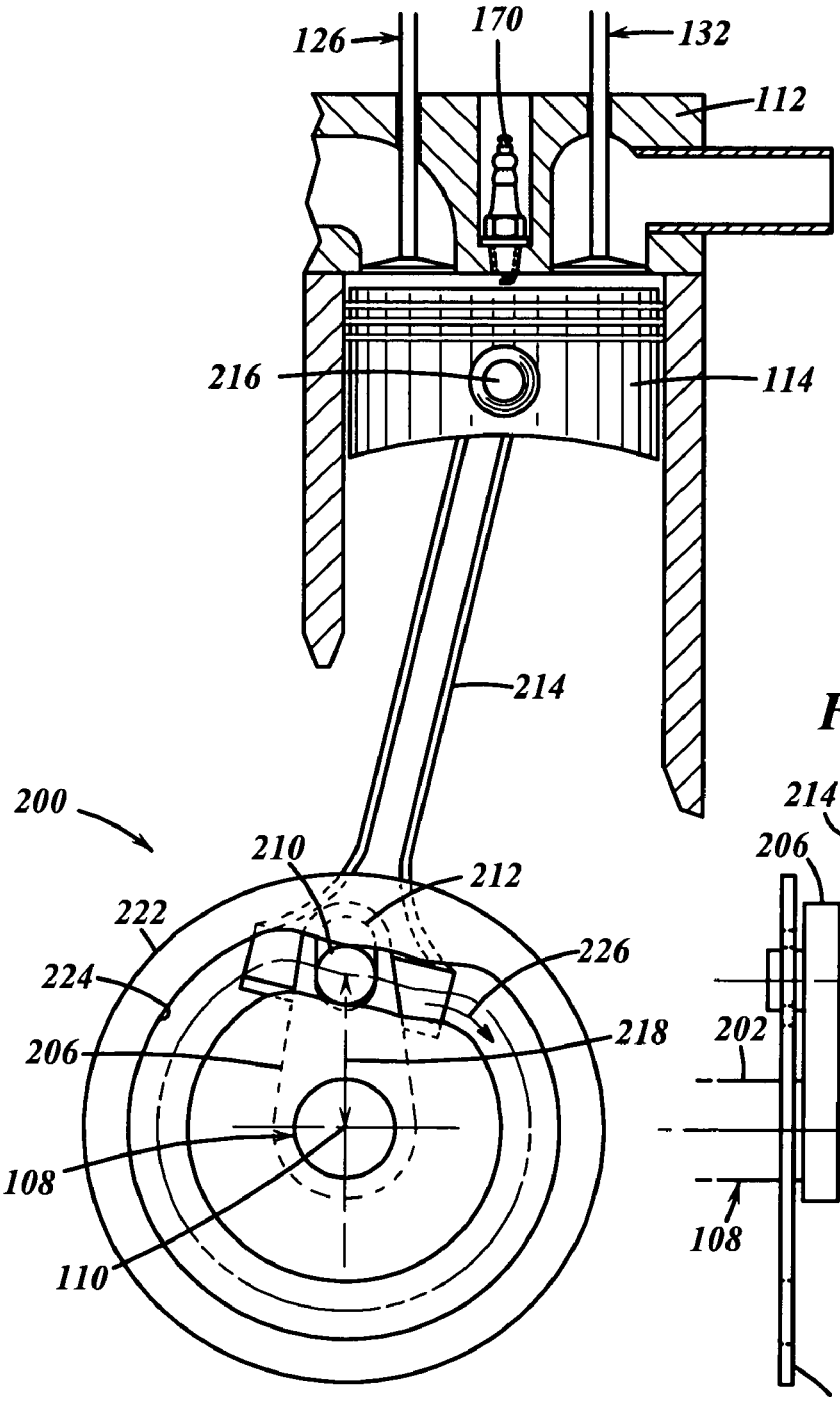
FIG. 7A is a front expanded view of the connecting rod/crank throw linkage of the expansion piston to the crankshaft in the dwell model engine of FIG. 6B.
Figure 7B:
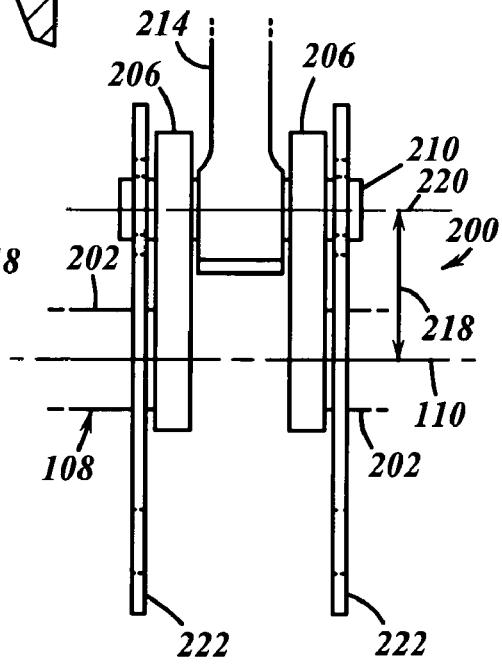
FIG. 7B is a side expanded view of the connecting rod/crank throw linkage of the expansion piston to the crankshaft in the dwell model engine of FIG. 6B.

Referring to FIGS. 7A and B, expanded front and side views of the connecting rod/crank throw linkage of the expansion piston 114 to the crankshaft 108 in the dwell model engine 101 is shown generally at 200. The linkage 200 includes an opposing pair of main crankshaft journals 202, which comprise a section of the crankshaft 108, both crankshaft main journals being aligned with the crankshaft axis (or centerline) 110. Attached to the inboard ends of each of the main journals 202 are crank throws (or web sections) 206, which are generally oblong plate-like attachments protruding radially from the main journals 202. A rod journal (or crank pin) 210 is slidably captured between a pair of radial slots 212 disposed within the crank webs (or throws) 206 such that the crank pin 210 is oriented parallel to the main journals 202, 204, but radially offset from the crankshaft axis 110. The slots 212 are sized to allow radial movement of the crank pin 210 relative to the crankshaft axis 110.

An expansion connecting rod 214 is pivotally attached at its top end via expansion piston pin 216 to the expansion piston 114. The bottom opposing end (or big end) of the expansion connecting rod 214 is pivotally mounted to the crank pin 210. Alternatively the crank pin 210 and expansion connecting rod 214 may be integrally attached as a single piece.

In distinct contrast to the baseline engine 100, as the crankshaft 108 rotates, the dwell model engine's 101 crank pin 210 is free to move along the radial slot 212 in the crank throws 206 and by so doing, able to change the effective crank throw radius (indicated by double headed arrow 218) of the crank pin 210 from the crankshaft axis 110. The effective crank throw radius 218 in this embodiment is the instantaneous distance between the axis of rotation 110 of the crank shaft and the position of the crank pin center 220. In the baseline model engine 100, the effective crank throw radius for the expansion piston 114 is substantially constant, in the dwell model engine 101, the effective crank throw radius 218 is variable for the expansion piston 114.

Even though the effective crank throw radius 218 is made variable via slot 212 in the crank throw 206, one skilled in the art would recognize that other means may be utilized to vary the radius 218. For example, a radial slot may be disposed in the connecting rod 214, while the crank pin 210 may be fixedly attached to the crank throw 206.

The position of the crank pin 210 in the slot 212 is controlled by a pair of templates 222, which are fixed to the stationary engine structure (not shown) of the engine 101. The templates 222 are generally circular plates, which are just outboard axially from the crank throws 206. Templates 222 are oriented as generally radial planes with respect to the crankshaft 108, and include a hole in the middle large enough to clear the crank shaft 108 and associated hardware (not shown).

A crank pin track 224 to guide the crank pin 210 is disposed in the templates 222, and the crank pin 210 protrudes through the crank throws 206 into the templates 222. The tracks 224 define a predetermined path (indicated via arrow 226), which the crank pin 210 must follow as it revolves about the crankshaft axis 110.

As will be explained in greater detail herein (see subsection VI. "Dwell Piston Motion Concept"), the mechanical linkage 200 provides a period of much slower expansion piston downward motion or "dwell", as compared to the expansion piston on the baseline model split-cycle engine 100, during a period of combustion. This dwell motion results in higher cylinder peak pressure without increasing expansion cylinder expansion ratio or compression cylinder peak pressure. Accordingly the dwell model engine 101 demonstrated thermal efficiency gains of approximately 4% over that of the baseline model engine 100.

IV. Basic Baseline and Dwell Engine Operation

Except for the connecting rod/crank throw linkage 200 of the expansion piston 114, the operation of the baseline model engine 100 and the dwell model engine 101 are substantially the same. Accordingly, the operation of both engines 100 and 101 will be illustrated with reference to the dwell model engine 101 only.

FIG. 6B illustrates the expansion piston 114 when it has reached its bottom dead center (BDC) position and has just started ascending (as indicated by arrow 166) into its exhaust stroke. Compression piston 116 is descending (arrow 168) through its intake stroke and is lagging the expansion piston 114.

During operation the expansion piston 114 leads the compression piston 116 by a phase angle 172, defined by the degrees of crank angle (CA) rotation the crankshaft 108 must rotate after the expansion piston 114 has reached its top dead center position in order for the compression piston 116 to reach its respective top dead center position. As determined in the first computerized study (see subsection I. "Overview"), in order to maintain advantageous thermal efficiency levels, the phase angle 172 is typically set at approximately 20 degrees. Moreover, the phase angle is preferably less than or equal to 50 degrees, more preferably less than or equal to 30 degrees and most preferably less than or equal to 25 degrees.

The inlet valve 130 is open to allow a predetermined volume of combustible mixture of fuel and air to be drawn into the compression chamber 144 and be trapped therein (i.e., the trapped mass as indicated by the dots on FIG. 6B). The exhaust valve 132 is also open allowing piston 114 to force spent products of combustion out of the combustion chamber 146.

The check valve 124 and crossover valve 126 of the crossover passage 122 are closed to prevent the transfer of ignitable fuel and spent combustion products between the two chambers 144 and 146. Additionally during the exhaust and intake strokes, the check valve 124 and crossover valve 126 seal the pressure chamber 128 to substantially maintain the pressure of any gas trapped therein from the previous compression and power strokes.

Figure 8:
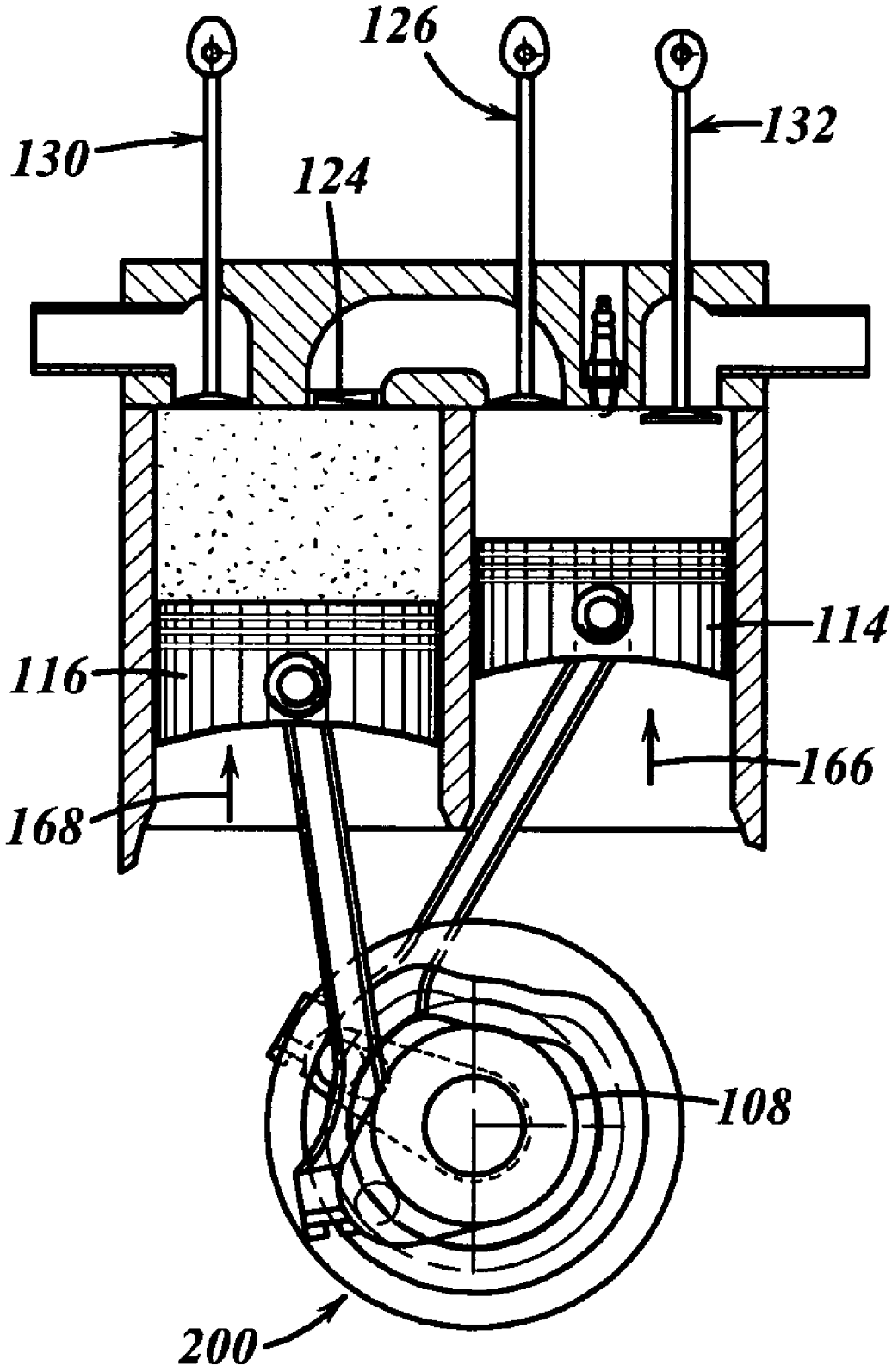
FIG. 8 is a schematic diagram of the dwell model split-cycle engine of FIG. 6B during partial compression of the compression stroke.

Referring to FIG. 8, partial compression of the trapped mass is in progress. That is inlet valve 130 is closed and compression piston 116 is ascending (arrow 168) toward its top dead center (TDC) position to compress the air/fuel mixture. Simultaneously, exhaust valve 132 is open and the expansion piston 114 is also ascending (arrow 166) to exhaust spent fuel products.

Figure 9:
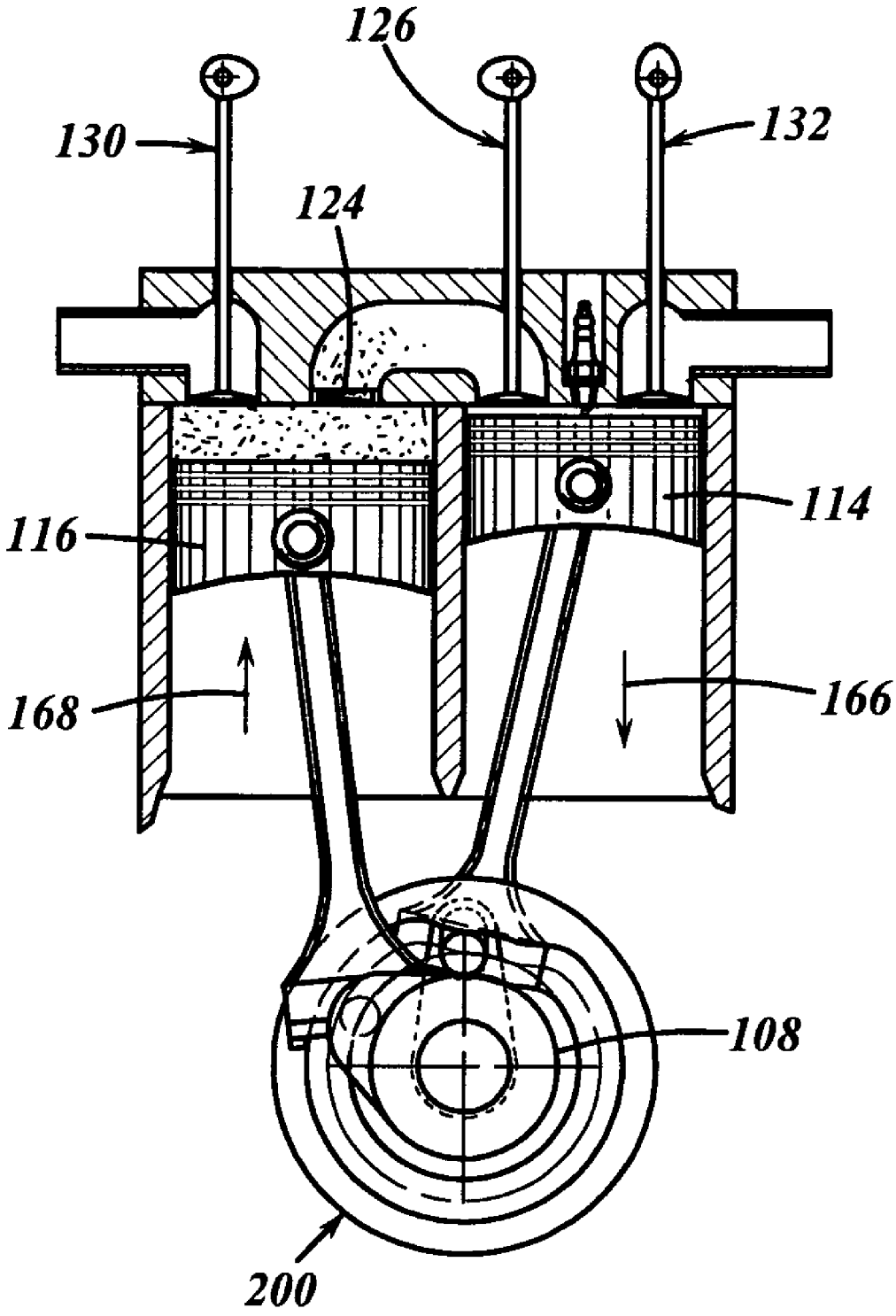
FIG. 9 is a schematic diagram of the dwell model split-cycle engine of FIG. 6B during full compression of the compression stroke.

Referring to FIG. 9, the trapped mass (dots) is further compressed and is beginning to enter the crossover passage 122 through check valve 124. The expansion piston 114 has reached its top dead center (TDC) position and is about to descend into its expansion stroke (indicated by arrow 166), while the compression piston 116 is still ascending through its compression stroke (indicated by arrow 168). At this point, check valve 124 is partially open. The crossover outlet valve 126, intake valve 130 and exhaust valve 132 are all closed.

The ratio of the expansion cylinder volume (i.e., combustion chamber 146) when the piston 114 is at BDC to the expansion cylinder volume when the piston is at TDC is defined herein as the Expansion Ratio. As determined in the first computerized study (referenced in subsection I, titled "Overview"), in order to maintain advantageous efficiency levels, the Expansion Ratio is typically set at approximately 120 to 1. Moreover, the Expansion Ratio is preferably equal to or greater than 20 to 1, more preferably equal to or greater than 40 to 1, and most preferably equal to or greater than 80 to 1.

Figure 10:
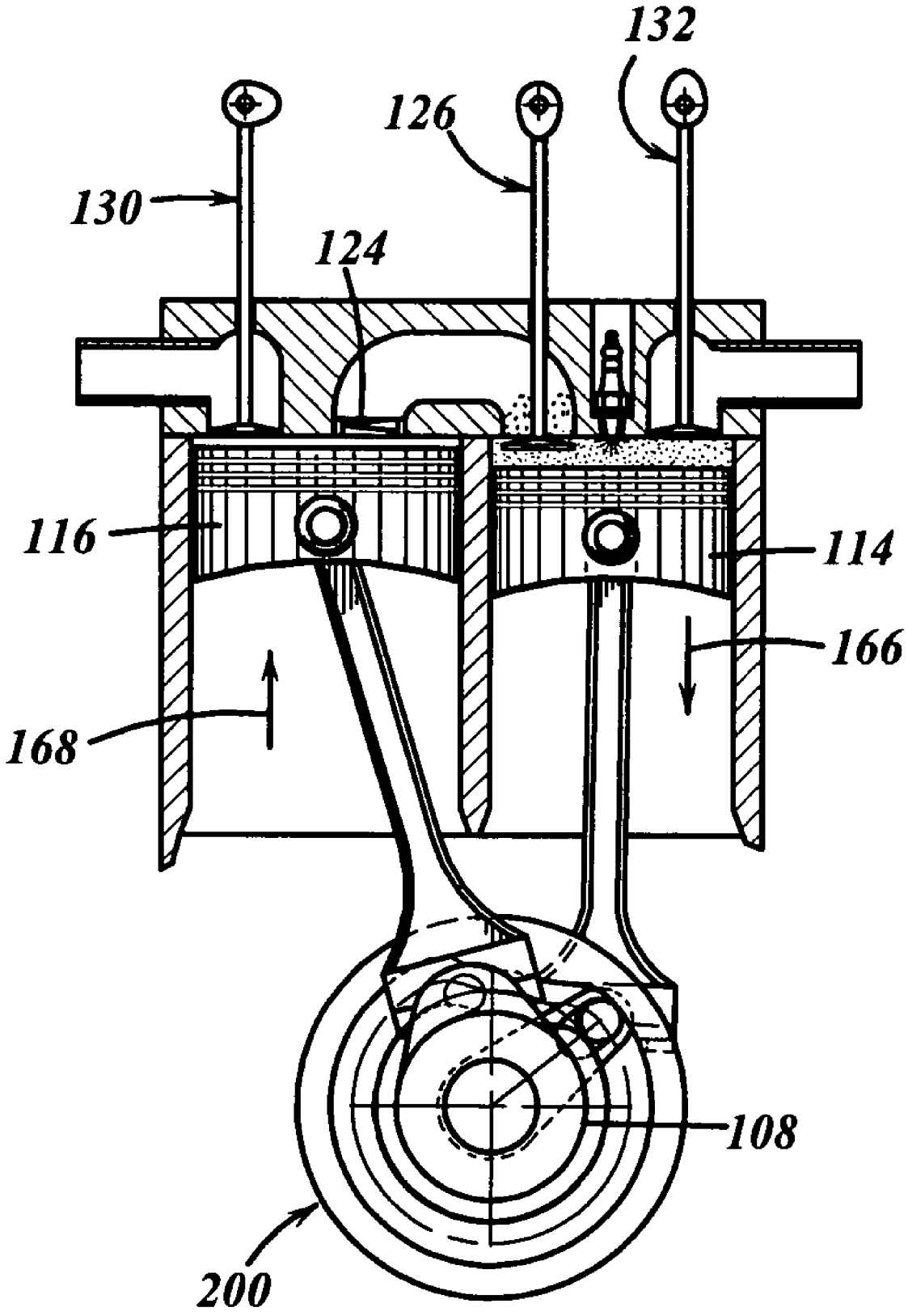
FIG. 10 is a schematic diagram of the dwell model split-cycle engine of FIG. 6B during the start of the combustion event.

Referring to FIG. 10, the start of combustion of the trapped mass (dotted section) is illustrated. The crankshaft 108 has rotated an additional predetermined number of degrees past the TDC position of expansion piston 114 to reach its firing position. At this point, spark plug 148 is ignited and combustion is started. The compression piston 116 is just completing its compression stroke and is close to its TDC position. During this rotation, the compressed gas within the compression cylinder 116 reaches a threshold pressure which forces the check valve 124 to fully open, while cam 140 is timed to also open crossover valve 126. Therefore, as the expansion piston 114 descends and the compression piston 116 ascends, a substantially equal mass of compressed gas is transferred from the compression chamber 144 of the compression cylinder 106 to the combustion chamber 146 of the expansion cylinder 104.

It is advantageous that the valve duration of crossover valve 126, i.e., the crank angle interval (CA) between the crossover valve opening (XVO) and crossover valve closing (XVC), be very small compared to the valve duration of the intake valve 130 and exhaust valve 132. A typical valve duration for valves 130 and 132 is typically in excess of 160 degrees CA. As determined in the first computerized study, in order to maintain advantageous efficiency levels, the crossover valve duration is typically set at approximately 25 degrees CA. Moreover, the crossover valve duration is preferably equal to or less than 69 degrees CA, more preferably equal to or less than 50 degrees CA, and most preferably equal to or less than 35 degrees CA.

Additionally, as also determined in the first computerized study, if the crossover valve duration and the combustion duration overlap by a predetermined minimum percentage of combustion duration, then the combustion duration is substantially decreased (that is the burn rate of the trapped mass is substantially increased). Specifically, the crossover valve 150 should remain open preferably for at least 5% of the total combustion event (i.e. from the 0% point to the 100% point of combustion) prior to crossover valve closing, more preferably for 10% of the total combustion event, and most preferably for 15% of the total combustion event. The longer the crossover valve 126 can remain open during the time the air/fuel mixture is combusting (i.e., the combustion event), the greater the increase in burn rate and efficiency levels will be, assuming other precautions have been taken as noted in the first computerized study with regard to avoiding flame propagation into the crossover passage and/or loss of mass from the expansion cylinder back into the crossover passage due to significant pressure rise in the expansion cylinder prior to crossover valve closure.

The ratio of the compression cylinder volume (i.e., compression chamber 144) when the piston 116 is at BDC to the compression cylinder volume when the piston is at TDC is defined herein as the Compression Ratio. Again, as determined in the first computerized study, in order to maintain advantageous efficiency levels, the Compression Ratio is typically set at approximately 100 to 1. Moreover, the Compression Ratio is preferably equal to or greater than 20 to 1, more preferably equal to or greater than 40 to 1, and most preferably equal to or greater than 80 to 1.

Figure 11:
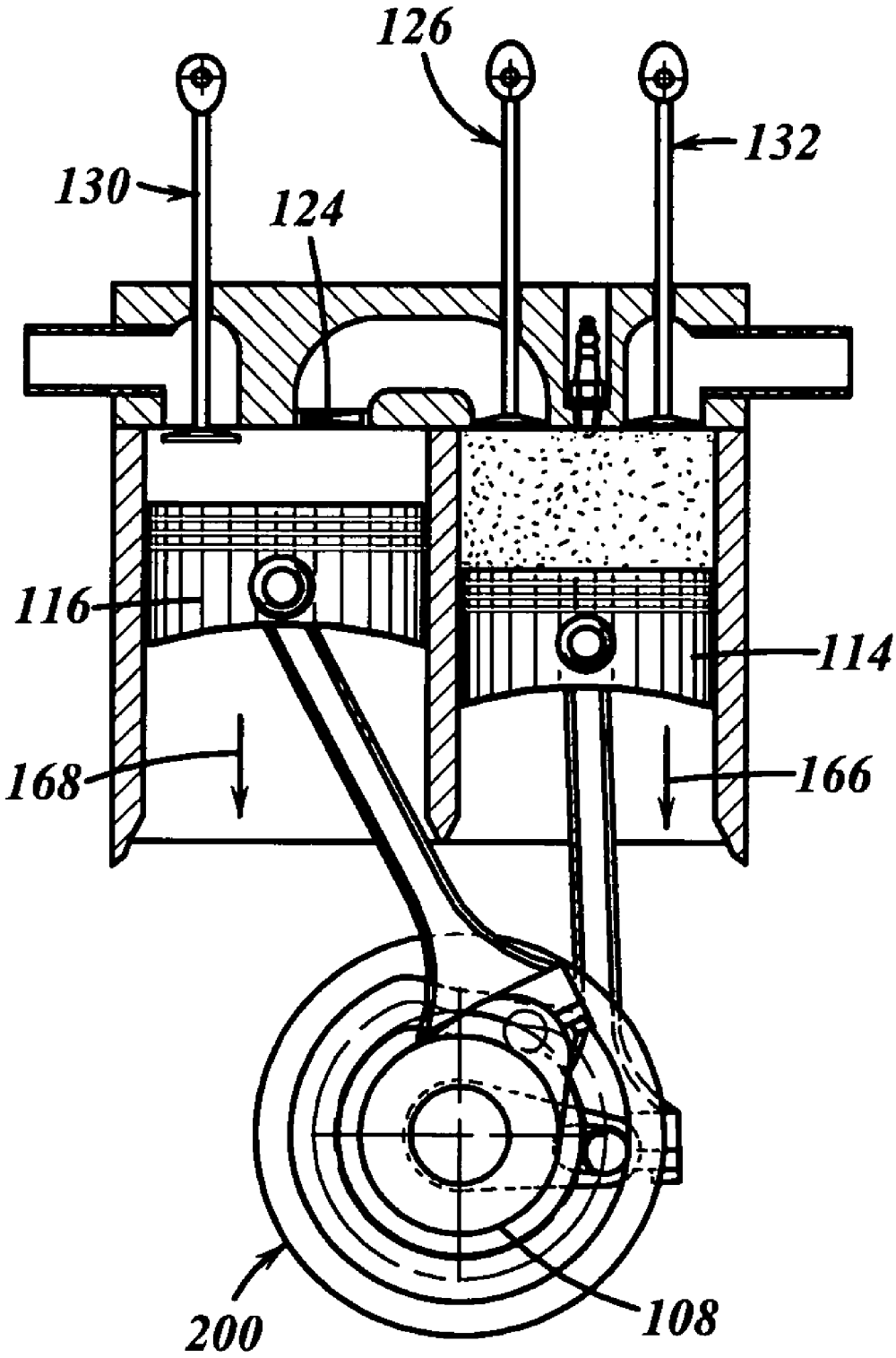
FIG. 11 is a schematic diagram of the dwell model split-cycle engine of FIG. 6B during the expansion stroke.

Referring to FIG. 11, the expansion stroke on the trapped mass is illustrated. As the air/fuel mixture is combusted, the hot gases drive the expansion piston 114 down. Simultaneously, the intake process has begun in the compression cylinder.

Figure 12:
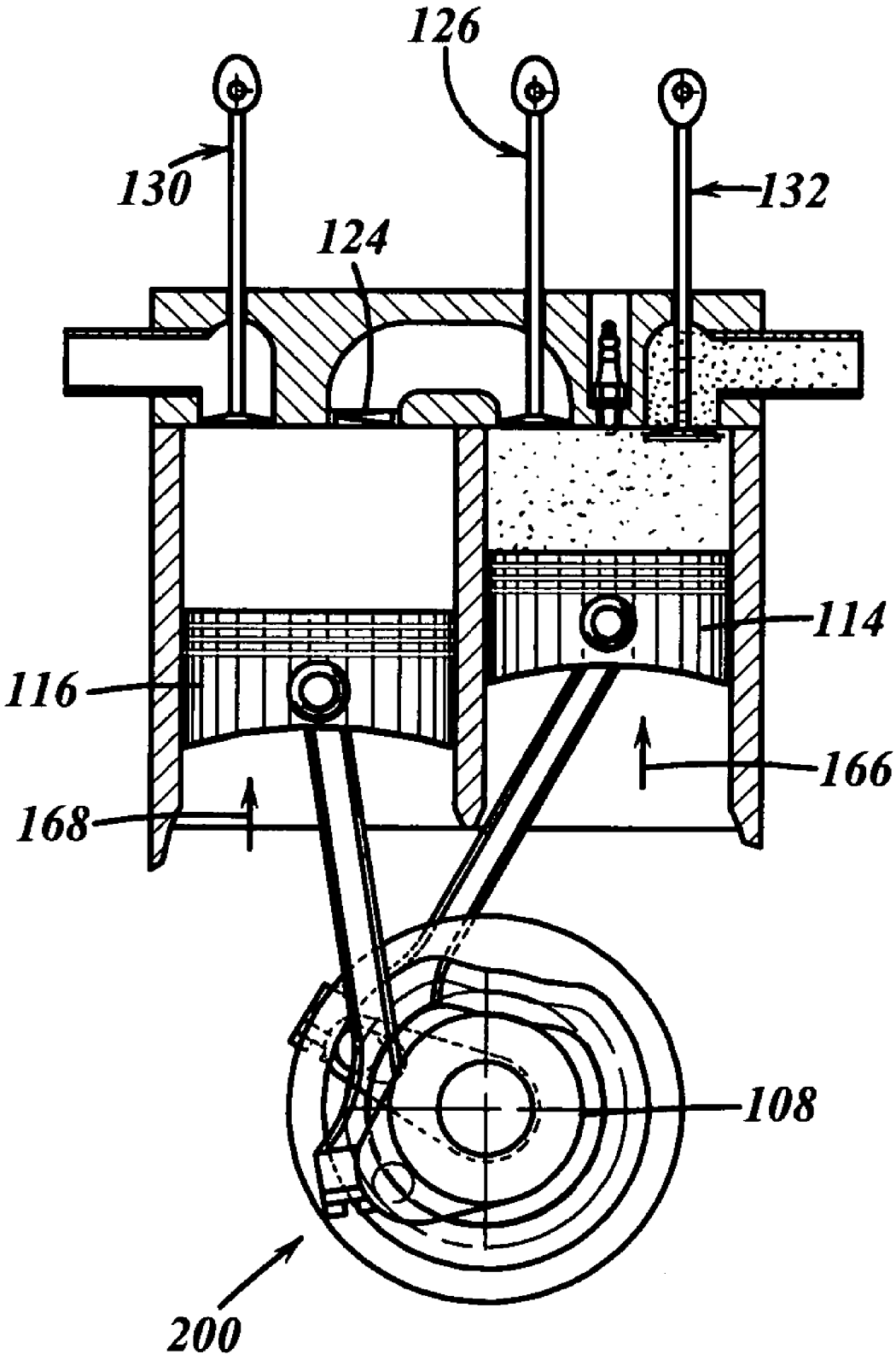
FIG. 12 is a schematic diagram of the dwell model split-cycle engine of FIG. 6B during the exhaust stroke.

Referring to FIG. 12, the exhaust stroke on the trapped mass is illustrated. As the expansion cylinder reaches BDC and begins to ascend again, the combustion gases are exhausted out the open valve 132 to begin another cycle.

Though the above embodiments show the expansion and compression pistons 114 and 116 connected directly to crankshaft 108 through connecting rods 214 and 150 respectively, it is within the scope of this invention that other means may also be employed to operatively connect the pistons 114 and 116 to the crankshaft 108. For example a second crankshaft may be used to mechanically link the pistons 114 and 116 to the first crankshaft 108.

Though this embodiment describes a spark ignition (SI) engine, one skilled in the art would recognize that compression ignition (CI) engines are within the scope of this type of engine also. Additionally, one skilled in the art would recognize that a split-cycle engine in accordance with the present invention can be utilized to run on a variety of fuels other than gasoline, e.g., diesel, hydrogen and natural gas.

V. Dwell and Baseline Split-Cycle Engine Parameters Used In The Second Computerized Study The first and second computerized studies were performed using a commercially available software package called GT-Power, owned by Gamma Technologies, Inc. of Westmont, Ill. GT-Power is a 1-d computational fluids-solver that is commonly used in industry for conducting engine simulations.

The primary purpose of the second computerized study was to evaluate the effects of a unique expansion piston "dwell" motion (or movement) on the performance of the dwell model split-cycle engine 101 as compared to the baseline model split-cycle engine 100 without the dwell movement. The dwell motion, in the exemplary embodiments herein, is produced by the mechanical linkage 200, which is added to the connecting rod/crank shaft assembly of the expansion cylinder 114, i.e., the connecting rod/crank throw linkage. The mechanical linkage 200 provides a period of much slower expansion piston downward motion or "dwell", as compared to the expansion piston on the baseline model split-cycle engine 100, during a period of combustion. Using a unique piston motion profile intended to represent motion that such a mechanism might provide resulted in higher cylinder peak pressure without increasing expansion cylinder expansion ratio or compression cylinder peak pressure, as well as higher thermal efficiency levels.

In order to assure a valid comparison between baseline and dwell models 100 and 101, care had to be taken in the selection of parameters for both engines. Table 1 shows the compression parameters used for the baseline and dwell engine 100, 101 comparison (note that no changes were made to the compression cylinder for the dwell concept). Table 2 shows the parameters used for the expansion cylinder in the baseline engine 100. See Table 4 for the parameters used on the dwell model engine's 101 expansion cylinder.

TABLE 1

Split-Cycle Baseline and Dwell Engine Parameters (Compression Cylinder)

| Parameter | Value |
|---|---|
| Bore | 4.410 in (112.0 mm) |
| Stroke | 4.023 in (102.2 mm) |
| Connecting Rod Length | 9.6 in (243.8 mm) |
| Crank Throw Radius | 2.000 in (50.8 mm) |
| Displacement Volume | 61.447 $in^3$ (1.007 L) |
| Clearance Volume | 0.621 $in^3$ (0.010 L) |
| Compression Ratio | 100:1 |
| Cylinder Offset | 1.00 in (25.4 mm) |
| TDC Phasing | 20 degrees CA |
| Engine Speed | 1400 rpm |

TABLE 2

Split-Cycle Baseline Engine Parameters (Expansion Cylinder)

| Parameter | Value |
|---|---|
| Bore | 4.000 in (101.6 mm) |
| Stroke | 5.557 in (141.1 mm) |
| Connecting Rod Length | 9.25 in (235.0 mm) |
| Crank Throw Radius | 2.75 in (69.85 mm) |
| Displacement Volume | 69.831 $in^3$ (1.144 L) |
| Clearance Volume | 0.587 $in^3$ (0.010 L) |
| Expansion Ratio | 120:1 |
| Cylinder Offset | 1.15 in (29.2 mm) |
| Air:Fuel Ratio | 18:1 |

Table 3 summarizes the valve events and combustion parameters, referenced to TDC of the expansion piston, with the exception of the intake valve events, which are referenced to TDC of the compression piston. These parameters were used for both the baseline model and dwell model engines 100 and 101.

TABLE 3

| Split-Cycle Baseline and Dwell Engine Breathing and Combustion Parameters | |
|---|---|
| Parameter | Value |
| Intake Valve Opening (IVO) | 2 degrees ATDC |
| Intake Valve Closing (IVC) | 170 degrees ATDC |
| Peak Intake Valve Lift | 0.412 in (10.47 mm) |
| Exhaust Valve Opening (EVO) | 134 2 degrees ATDC |
| Exhaust Valve Closing (EVC) | 2 degrees BTDC |
| Peak Exhaust Valve Lift | 0.362 in (9.18 mm) |
| Crossover Valve Opening (XVO) | 5 degrees BTDC |
| Crossover Valve Closing (XVC) | 22 degrees ATDC |
| Peak Crossover Valve Lift | 0.089 in (2.27 mm) |
| 50% Burn Point (Combustion Event) | 32 degrees ATDC |
| Combustion Duration (10–90%) | 22 degrees CA |

VI. Dwell Piston Motion Concept

Figure 13:
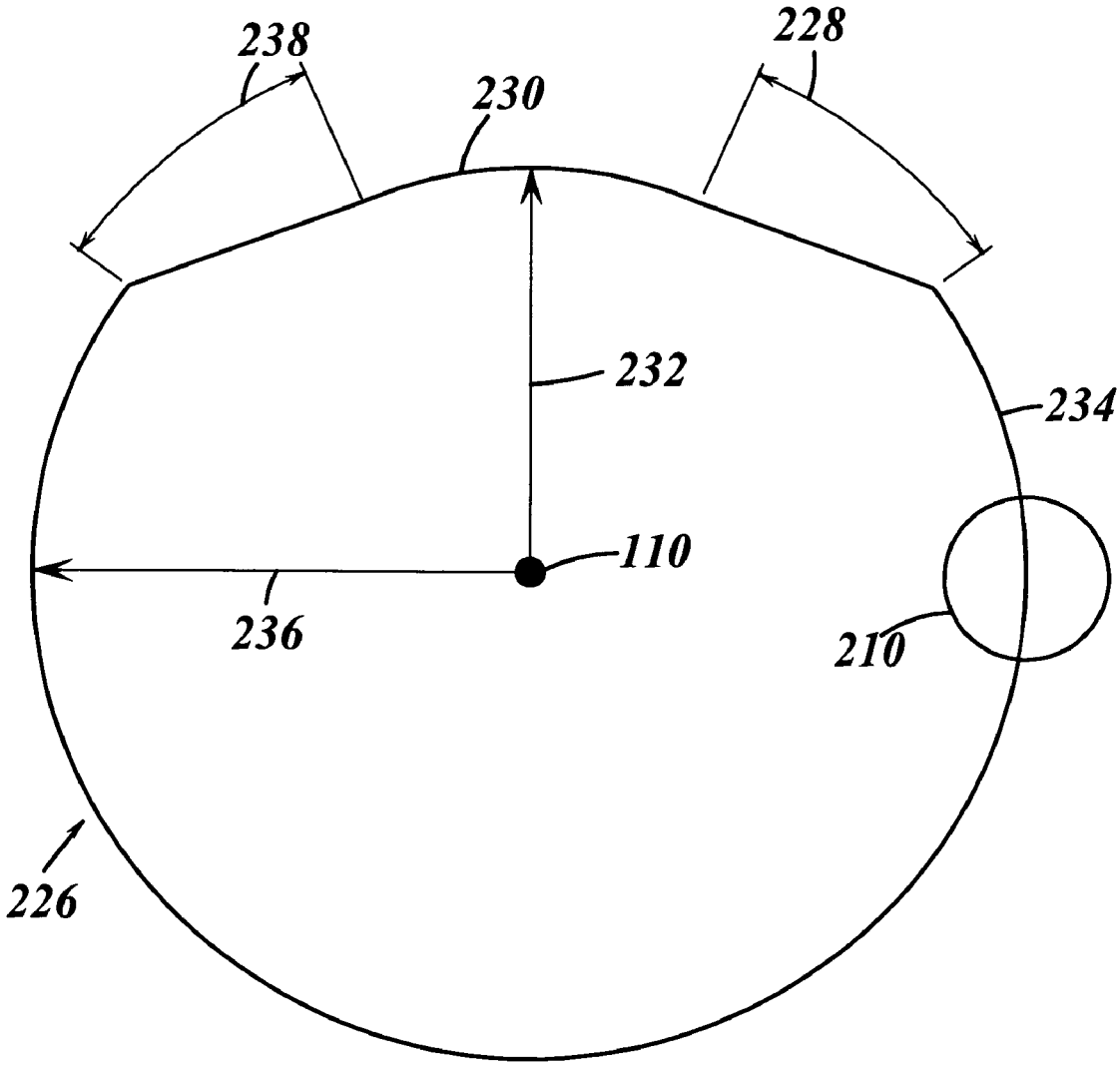
FIG. 13 is a schematic diagram of the crank pin motion of the dwell model engine of FIG. 6B.

Referring to FIG. 13, an expanded view of the path 226 taken by crank pin 210 about crankshaft axis 110 is illustrated. The path 226 is defined by crank pin track 224 of mechanical linkage 200, which guides the crank pin 210 (best seen in FIGS. 7A and B) of the dwell model engine 101.

Path 226 includes a first transition region 228, which moves the crank pin 210 from an inner circle 230, having a first inner effective crank throw radius 232, to an outer circle 234, having a second outer effective crank throw radius 236. The transition region 228 begins a predetermined number of degrees CA after top dead center, and occurs during at least a portion of the combustion event and during the expansion piston's 114 downward stroke. The path 226 then remains on the outer circle 234 for the rest of the downward stroke and most of the upward stroke of the expansion piston 114. Path 226 then includes a second transition region 238, which moves the crank pin 210 from the outer circle 234 to the inner circle 230 near the end of the upward stroke of the expansion piston 114. The basic dwell model engine 101 expansion piston crank pin 210 motion for the second computerized study was set as follows:

1. From piston TDC until 24 degrees CA after TDC, crank pin 210 would be on inner circle 230.
2. From 24 degrees CA after TDC to 54 degrees after TDC, crank pin 210 would travel through the first transition region 228 linearly versus crank angle from the inner effective crank throw radius 232 to the outer effective crank throw radius 236.
3. From 54 degrees CA after TDC through the rest of the downward stroke and most of the upward stroke until 54 degrees before TDC, crank pin 210 would remain on outer circle 234.
4. From 54 degrees CA before TDC until 24 degrees before TDC, crank pin 210 would travel through the second transition region 238 linearly versus crank angle from the outer effective crank throw radius 236 to the inner effective crank throw radius 232.
5. From 24 degrees CA before TDC until 24 degrees CA after TDC, the crankpin 210 would remain on the inner circle 230.

Though the above described path 226 was utilized in the second computerized study, one skilled in the art would recognize that various connecting rod/crank throw linkages for various split-cycle engines could be designed to provide any number of other shaped paths and dwell expansion piston movements.

To maintain the same stroke and relative piston positions as the baseline engine 100 while following path 226, the inner effective crank throw radius 232 was decreased from the baseline of 2.75 inches (as shown in Table 2) to 2.50 inches, and the outer effective crank throw radius 236 was increased from 2.75 inches to 3.00 inches. Additionally the connecting rod length was increased from 9.25 inches (Table 2) to 9.50 inches. Table 4 summarizes the parameters used for the expansion cylinder 104 on the dwell engine 101.

TABLE 4

| Split-Cycle Dwell Engine Parameters (Expansion Cylinder) | |
|---|---|
| Parameter | Value |
| Bore | 4.000 in (101.6 mm) |
| Stroke | 5.557 in (141.1 mm) |
| Connecting Rod Length | 9.50 in (235.0 mm) |
| Inner Crank Throw Radius | 2.50 in (63.5 mm) |
| Outer Crank Throw Radius | 3.00 in (76.2 mm) |
| Displacement Volume | 69.831 $in^3$ (1.144 L) |
| Clearance Volume | 0.587 $in^3$ (0.010 L) |
| Expansion Ratio | 120:1 |
| Cylinder Offset | 1.15 in (29.2 mm) |
| Air:Fuel Ratio | 18:1 |

Figure 14:
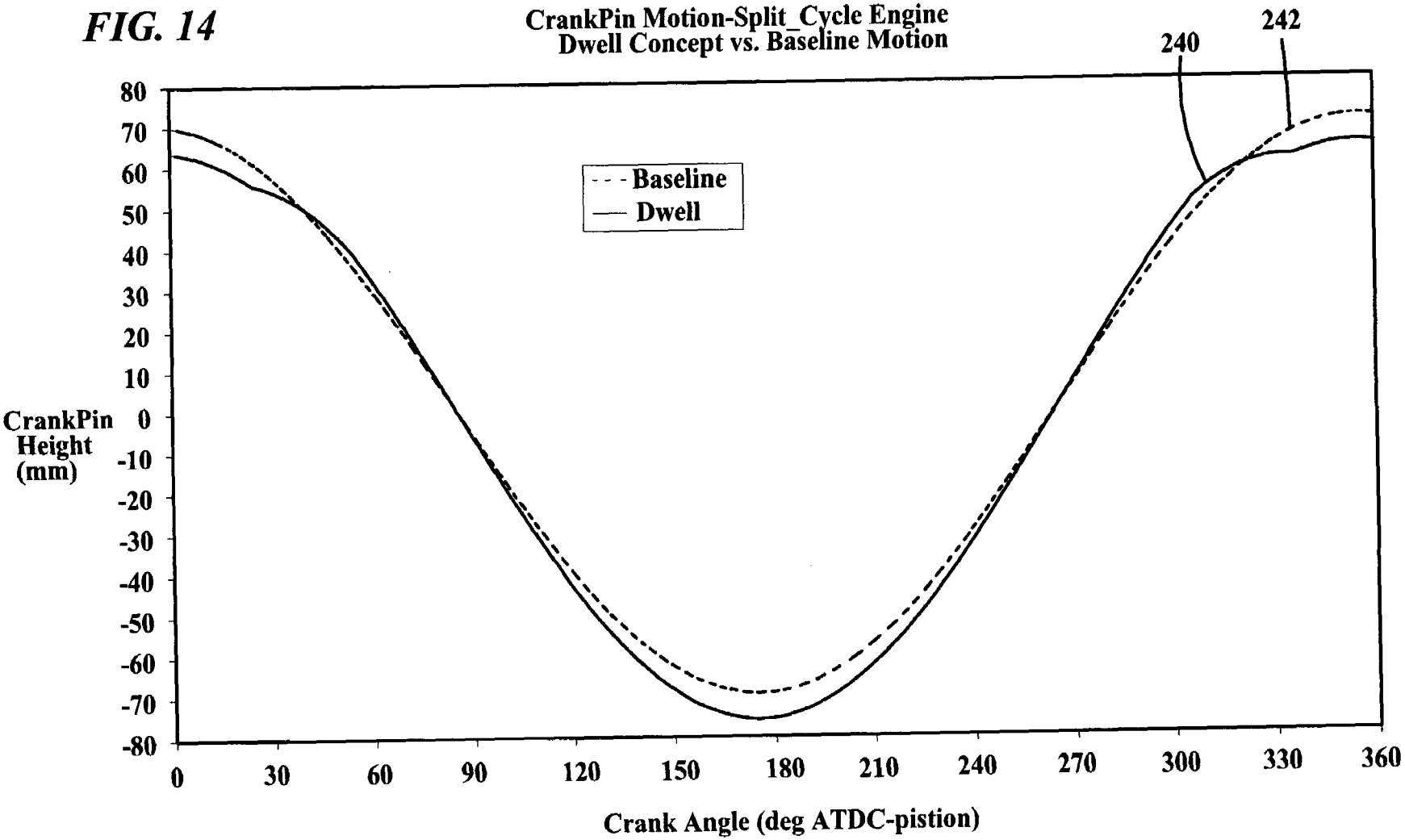
FIG. 14 is a graph of the crank pin motion of the baseline model engine of FIG. 6A and the dwell model engine of FIG. 6B.

Referring to FIG. 14, the resulting expansion piston crank pin 210 motion of the dwell engine 101 as compared to crank pin motion of the baseline engine 100 is illustrated. Graph 240 represents the dwell engine crank pin motion, and graph 242 represents the baseline engine crank pin motion.

Figure 15:
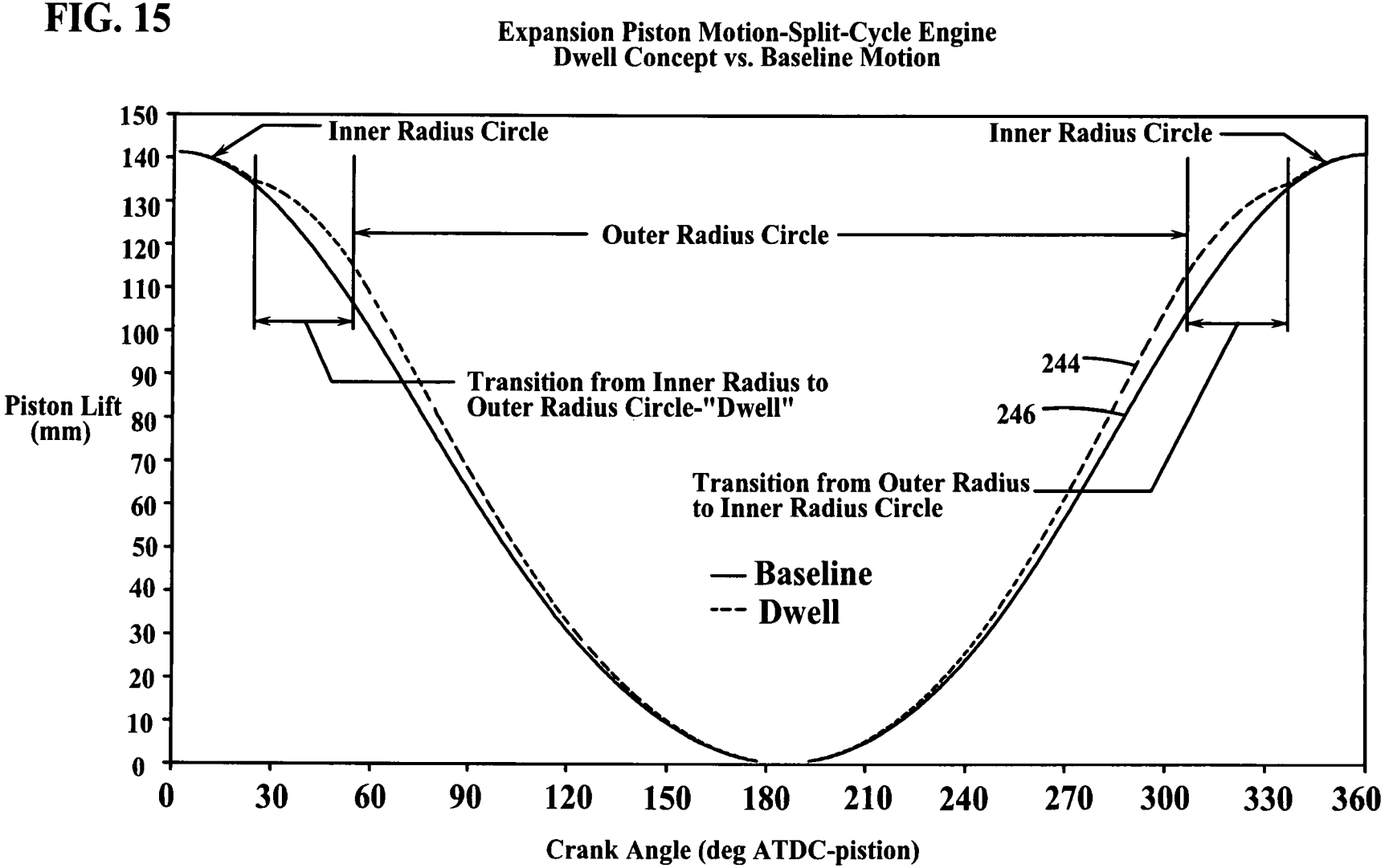
FIG. 15 is a graph of the expansion piston motion of the baseline model engine of FIG. 6A and the dwell model engine of FIG. 6B.

Referring to FIG. 15, the resulting expansion piston motion of the dwell engine 101 as compared to the expansion piston motion of the baseline engine is illustrated. Graph 244 represents the dwell engine expansion piston motion, and graph 246 represents the baseline engine expansion piston motion.

Figure 16:
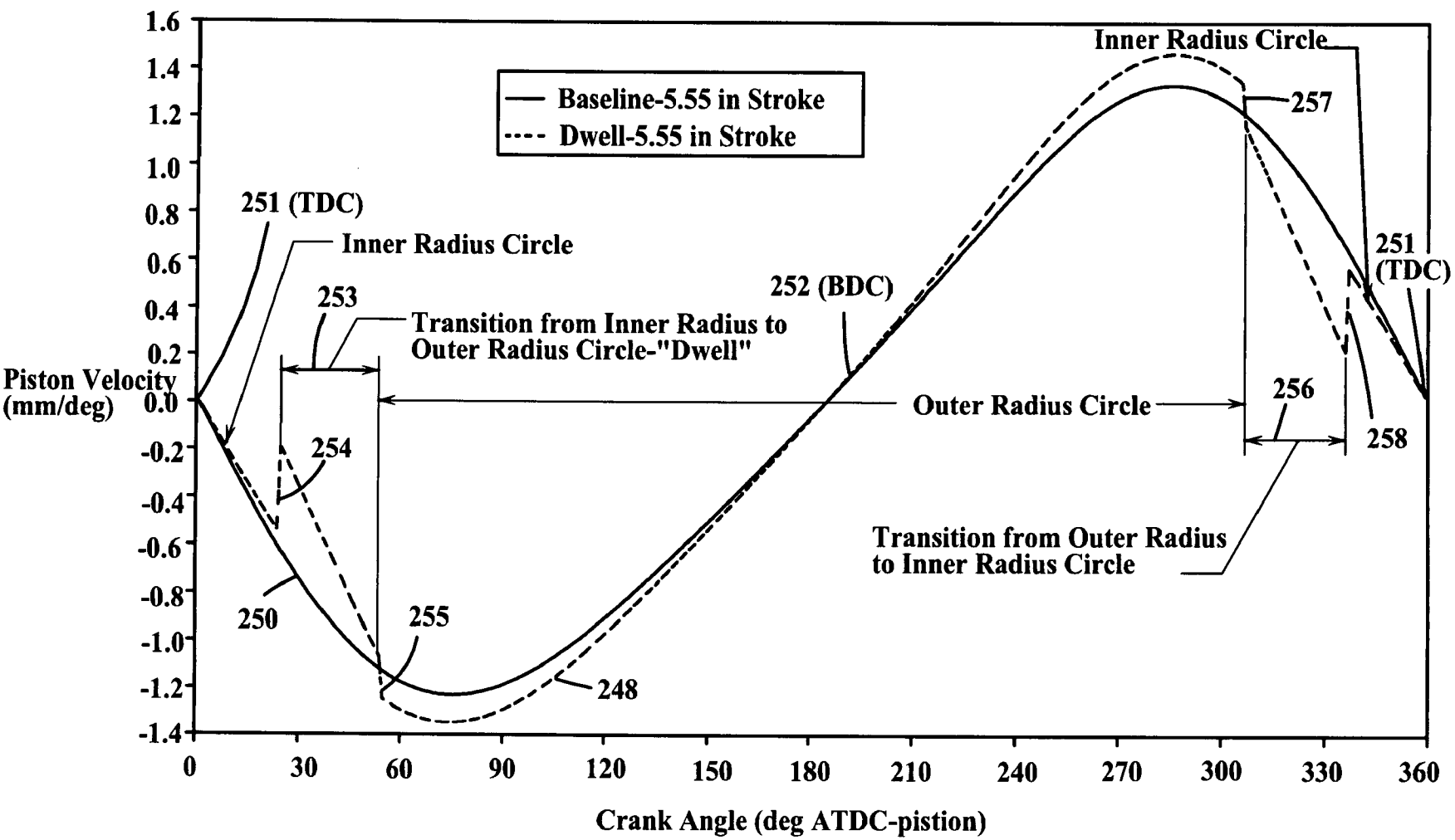
FIG. 16 is a graph of the expansion piston velocity of the baseline model engine of FIG. 6A and the dwell model engine of FIG. 6B.

Referring to FIG. 16, the resulting expansion piston velocity of the dwell engine 101 as compared to the expansion piston velocity of the baseline engine is illustrated. Graph 248 represents the dwell engine expansion piston velocity, and graph 250 represents the baseline engine expansion piston velocity.

In comparing graphs 248 and 250, it can be seen that both the baseline model expansion piston (baseline piston) and dwell model expansion piston (dwell piston) are traveling at essentially a zero (0) velocity at the TDC points 251 and at the BDC point 252. Both the baseline and dwell pistons travel downward (the negative sign represents downward velocity and the positive sign represents upwards velocity) at about the same speed initially from TDC. However, when the dwell piston initially enters the first transition section of the dwell graph 253 (about 24 degrees ATDC), the dwell piston's downward velocity decelerates rapidly as indicated by the almost vertical portion 254 of the dwell graph first transition section 253. This is because the downward motion of the dwell piston slows substantially as the dwell crank pin 210 begins to move radially along the crank throw slots 212 from the inner effective crank throw radius 232 to the inner effective crank throw radius 236. Moreover, during the entire transition region 253, the dwell piston's downward velocity is substantially slower than that of the baseline piston.

Since the first transition section 253 is timed to coincide with at least a portion of the combustion event, the slower downward motion of the dwell piston during the first transition section 253 provides more time for combustion to propagate and to build up pressure relative to the increase in combustion chamber volume. As a result, higher expansion cylinder peak pressures are reached, and the expansion cylinder pressure is maintained for a longer period of time, in the dwell model engine 101 than in the baseline engine 100. Accordingly, the dwell model engine 101 experiences a significant gain in efficiency over the baseline engine 100, e.g., approximately 4%.

At the end of the first transition section 253 (about 54 degrees ATDC) the crank pin 210 has reached the outer radial end of slots 212, and the transition from the inner effective crank throw radius 232 to the outer effective crank throw radius 236 is essentially complete. At this point, the dwell piston experiences a rapid acceleration (as indicated by the almost vertical line 255), whereupon its downward velocity rapidly catches up to and excedes the baseline piston.

The dwell piston velocity will essentially remain greater than the baseline piston velocity for that portion of the crank pin's path 226, which has the outer effective crank throw radius 236. However, when the dwell piston initially enters the second transition section of the dwell graph 256 (about 24 degrees BTDC), the dwell piston's upwards velocity decelerates rapidly below that of the baseline piston's velocity as indicated by the almost vertical portion 257 of the second transition section 256. This is because the upwards motion of the dwell piston slows substantially as the dwell crank pin 210 begins to move radially along the crank throw slots 212 from the outer effective crank throw radius 236 to the inner effective crank throw radius 234.

At the end of the second transition section 256 (about 54 degrees BTDC) the crank pin 210 has reached the inner radial end of slots 212, and the transition from the outer effective crank throw radius 236 to the inner effective crank throw radius 232 is essentially complete. At this point, the dwell piston again experiences a rapid acceleration (as indicated by the almost vertical line 258), whereupon its upward velocity almost catches up to the baseline piston. The dwell and baseline piston upward velocities then slow to zero as they reach TDC to begin the cycle again.

VII. Summary Of The Results

By slowing the piston motion down, the cylinder pressure is given more time to build up during the combustion event relative to the increase in combustion chamber volume. This produces higher expansion cylinder peak pressure without increasing expansion cylinder expansion ratio or compression cylinder peak pressure. Accordingly, the overall thermal efficiency of the dwell model split-cycle engine 101 is increased significantly, e.g., approximately 4% over the baseline split-cycle engine 100.

Table 6 summarizes the results of the performance runs of the baseline model engine 100 and the dwell model engine 101. Indicated thermal efficiency (ITE) of the dwell model engine 101 is predicted to increase by 1.7 points above the baseline engine 100. That is, the baseline engine 100 had a predicted ITE of 38.8% as compared to a predicted ITE of 40.5% for the dwell model engine 101. This represents a predicted increase of 4.4% (i.e., 1.7 points/38.8%*100= 4.4%) over the baseline model engine.

TABLE 5

Summary of Predicted Baseline and Dwell Engine Performance

| Parameter | Baseline | Dwell |
|---|---|---|
| Indicated Torque (ft-lb.) | 94.0 | 96.6 |
| Indicated Power (hp) | 25.1 | 25.8 |
| Net IMEP (psi) | 54.4 | 55.5 |
| ITE (points) | 38.8 | 40.5 |
| Peak Cylinder Pressure, Compression Cylinder (psi) | 897 | 940 |
| Peak Cylinder Pressure, Expansion Cylinder (psi) | 868 | 915 |

Figure 17A:
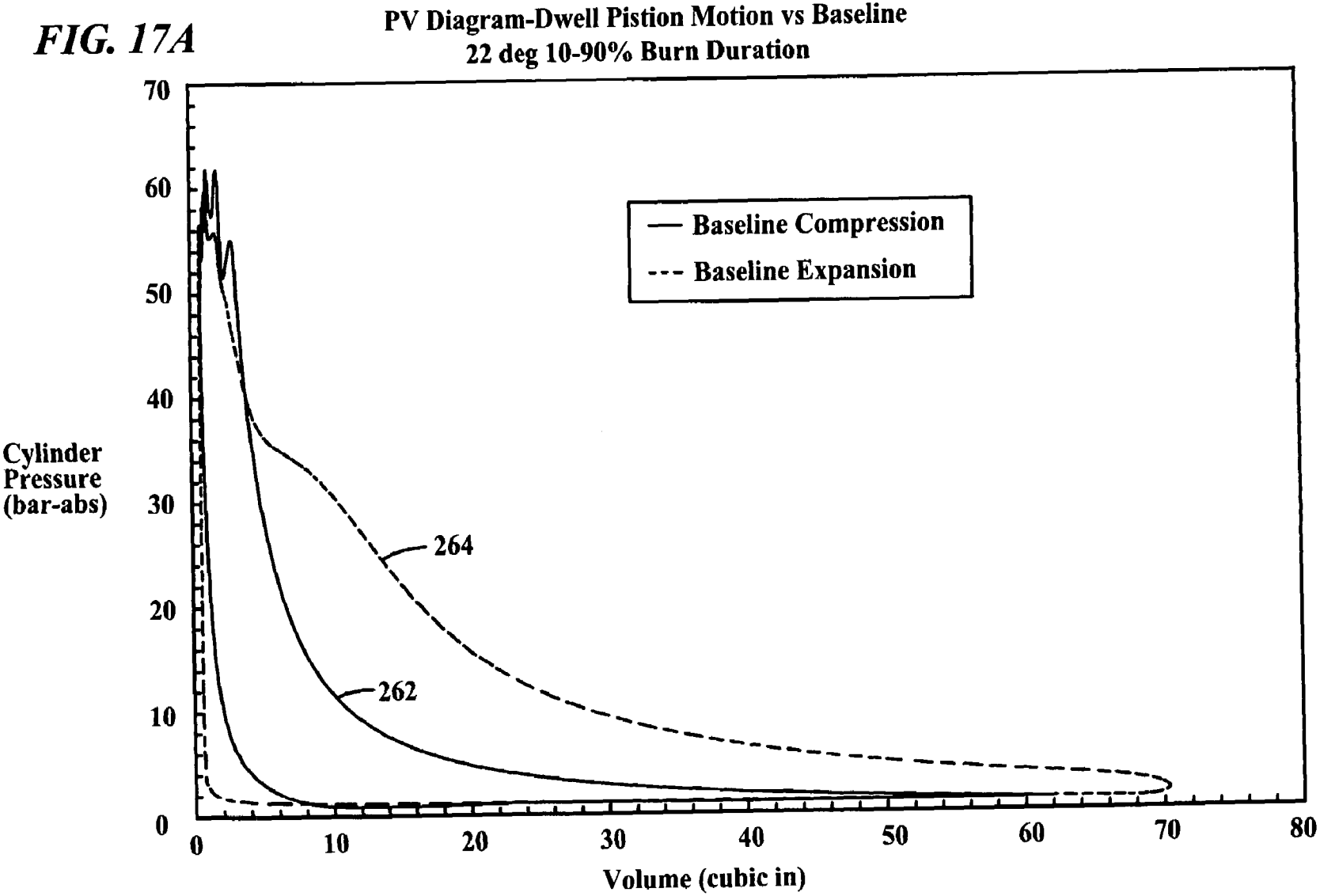
FIG. 17A is a Pressure vs. Volume diagram of the baseline model engine of FIG. 6A.
Figure 17B:
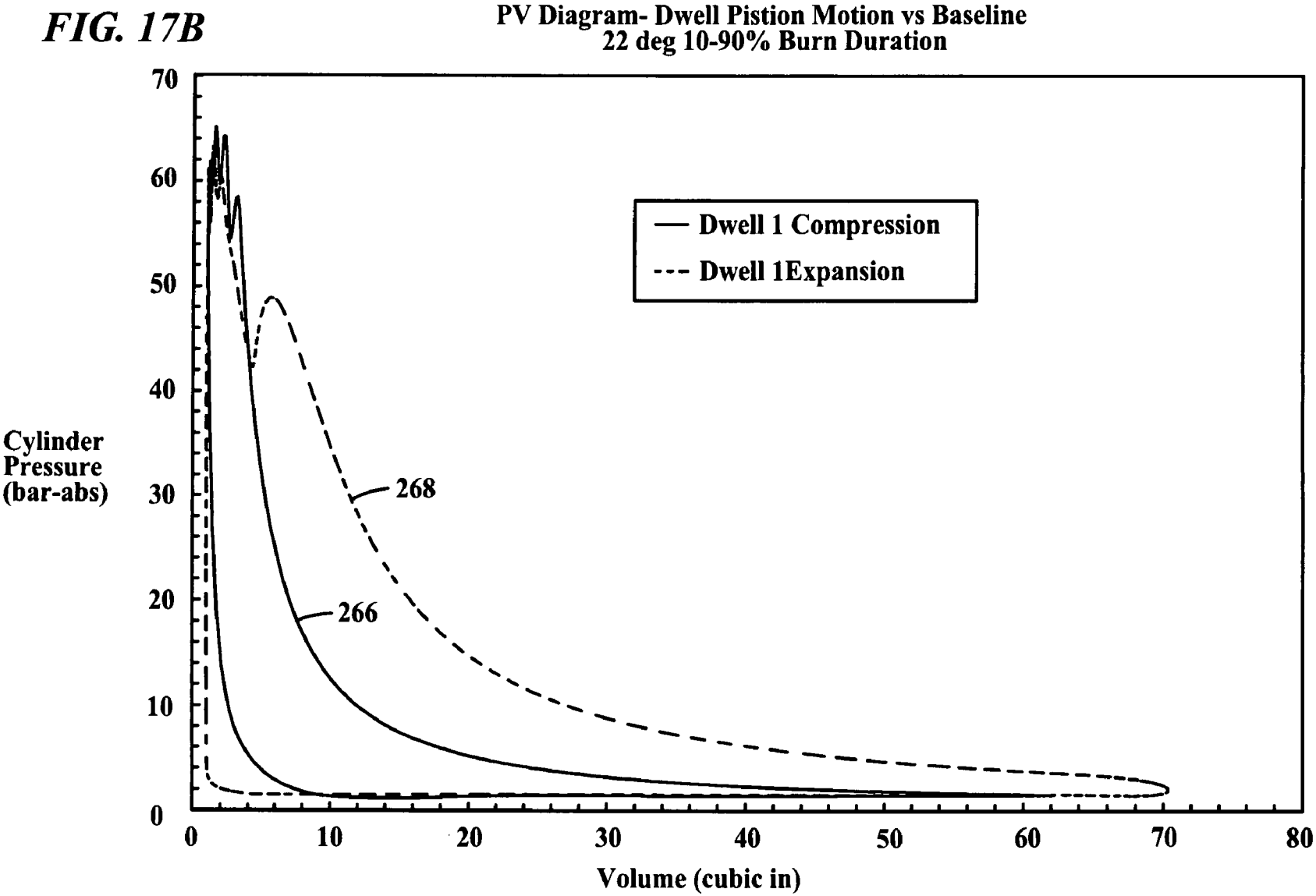
FIG. 17B is a Pressure vs. Volume diagram of the dwell model engine of FIG. 6B.

Referring to FIGS. 17A and B, the changes in cylinder pressure versus volume created by the dwell piston motion versus baseline piston motion are illustrated. Graphs 262 and 264 of FIG. 17A represent the baseline compression and expansion piston motion respectively. Graphs 266 and 268 of FIG. 17B represent the dwell compression and expansion piston motion respectively. Note that the baseline compression (graph 262) and dwell compression (graph 266) curves are substantially equal.

Figure 18:
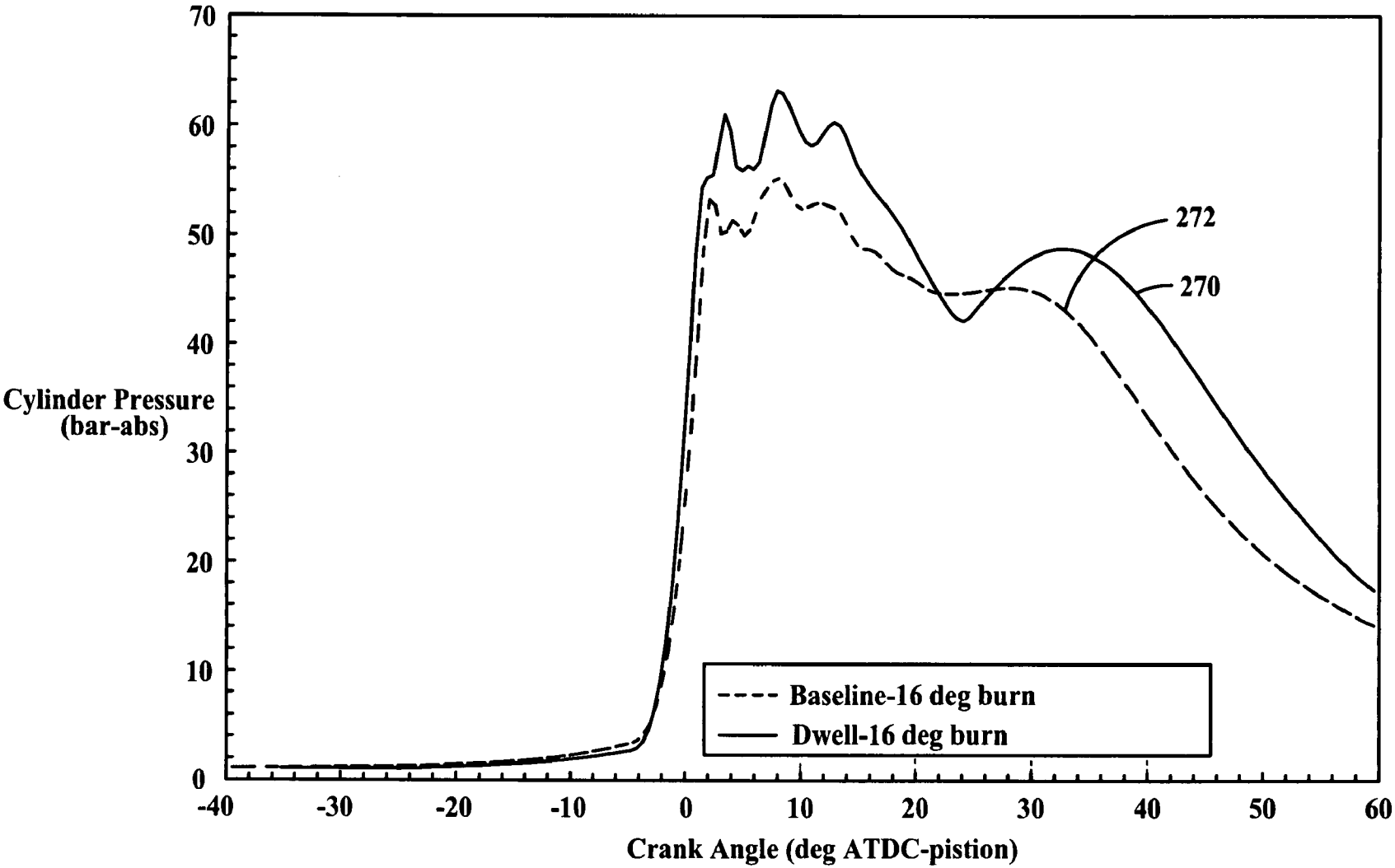
FIG. 18 is a graph of the expansion cylinder pressure vs. crank angle of the baseline model engine of FIG. 6A and the dwell model engine of FIG. 6B.

Referring to FIG. 18, the expansion cylinder pressure vs. crank angle for both the baseline model engine 100 and dwell model engine 101 are illustrated in graphs 270 and 272 respectively. As the graphs 270 and 272 indicate, the dwell model engine 101 was able to obtain higher peak expansion cylinder pressures, and maintain those pressures over a larger crank angle range, than the baseline model engine 100. This contributed to the predicted efficiency gains of the dwell model engine.

Note that the graphs 270 and 272 are taken with a faster burn rate (or flame speed) than the previous tests. That is, graphs 270 and 272 were plotted using a 16 degree CA combustion duration, while the previous performance calculations and graphs of the second computerized study utilized a 22 degree CA combustion duration. This was done because the split-cycle engine is predicted to be potentially capable of obtaining these faster flame speeds. Moreover, there was nothing to indicate that the comparative results between the baseline model engine 100 and dwell model engine 101 would be any less valid at the faster flame speeds.

While various embodiments are shown and described herein, various modifications and substitutions may be made thereto without departing from the spirit and scope of the invention. Accordingly, it is to be understood that the present invention has been described by way of illustration and not limitation.

What is claimed is:

1. An engine comprising:

a crankshaft having a crank throw, the crankshaft rotating about a crankshaft axis;

a compression piston slidably received within a compression cylinder and operatively connected to the crankshaft such that the compression piston reciprocates through an intake stroke and a compression stroke of a four stroke cycle during a single rotation of the crankshaft;

an expansion piston slidably received within an expansion cylinder;

a connecting rod pivotally connected to the expansion piston;

a mechanical linkage rotationally connecting the crank throw to the connecting rod about a connecting rod/crank throw axis such that the expansion piston reciprocates through an expansion stroke and an exhaust stroke of the four stroke cycle during the same rotation of the crankshaft; and a non-circular path established by the mechanical linkage which the connecting rod/crank throw axis travels around the crankshaft axis, the distance between the connecting rod/crank throw axis and crankshaft axis at any point in the path defining an effective crank throw radius, the path including a first transition region from a first effective crank throw radius to a second effective crank throw radius through which the connecting rod/crank throw axis passes during at least a portion of a combustion event in the expansion cylinder.

2. The engine of claim 1 wherein the velocity of the expansion piston decelerates when the connecting rod/crank throw axis is traveling through at least a portion of the first transition region.

3. The engine of claim 2 wherein the velocity of the expansion piston decelerates when the connecting rod/crank throw axis initially enters the first transition region and accelerates when the connecting rod/crank throw axis exits the first transition region.

4. The engine of claim 1 wherein the first effective crank throw radius is smaller than the second effective crank throw radius.

5. The engine of claim 1 wherein the first transition region begins a predetermined number of crank angle degrees CA past top dead center.

6. The engine of claim 1 wherein the path includes a second transition region from the second effective crank throw radius to the first effective crank throw radius.

7. The engine of claim 1 wherein the mechanical linkage comprises:

a crank pin attached to the connecting rod, the crank pin having the connecting rod/crank throw axis as a centerline thereof; and a slot disposed in the crank throw which slidably captures the crank pin, the slot being sized to allow radial movement of the crank pin relative to the crankshaft axis.

8. The engine of claim 7 wherein the mechanical linkage comprises:

a template attached to a stationary portion of the engine, the template including a crank pin track into which the crank pin extends, the crank pin track movably capturing the crankpin such that the connecting rod/crank throw axis is guided through the path.

9. The engine of claim 8 wherein the mechanical linkage comprises:

a pair of crank throws extending from an opposing pair of crank shaft journals of the crankshaft, each crank throw having a slot disposed therein; and the crank pin being slidably captured by the slots such that the crank pin is oriented parallel to, but offset from, the crankshaft.

10. The engine of claim 9 wherein the mechanical linkage comprises;

an opposing pair of templates, each with a crank pin track to moveably capture the crank pin and guide the connecting rod/crank throw axis through the path.

11. An engine comprising:

a crankshaft having a crank throw, the crankshaft rotating about a crankshaft axis;

a compression piston slidably received within a compression cylinder and operatively connected to the crankshaft such that the compression piston reciprocates through an intake stroke and a compression stroke of a four stroke cycle during a single rotation of the crankshaft;

an expansion piston slidably received within an expansion cylinder;

a connecting rod pivotally connected to the expansion piston;

a mechanical linkage rotationally connecting the crank throw to the connecting rod about a connecting rod/crank throw axis such that the expansion piston reciprocates through an expansion stroke and an exhaust stroke of the four stroke cycle during the same rotation of the crankshaft; and a non-circular path established by the mechanical linkage which the connecting rod/crank throw axis travels around the crankshaft axis, the distance between the connecting rod/crank throw axis and crankshaft axis at any point in the path defining an effective crank throw radius, the path including a first transition region beginning a predetermined number of degrees CA past top dead center, the first transition region transitioning from a first effective crank throw radius to a larger second effective crank throw radius through which the connecting rod/crank throw axis passes during at least a portion of a combustion event in the expansion cylinder.

12. The engine of claim 11 wherein the velocity of the expansion piston decelerates when the connecting rod/crank throw axis is traveling through at least a portion of the first transition region.

13. The engine of claim 11 wherein the velocity of the expansion piston decelerates when the connecting rod/crank throw axis initially enters the first transition region and accelerates when the connecting rod/crank throw axis exits the first transition region.

14. The engine of claim 11 wherein the path includes a second transition region from the second effective crank throw radius to the first effective crank throw radius.

15. The engine of claim 11 wherein the mechanical linkage comprises:

a crank pin attached to the connecting rod, the crank pin having the connecting rod/crank throw axis as a centerline thereof;

a slot disposed in the crank throw which slidably captures the crank pin, the slot being sized to allow radial movement of the crank pin relative to the crankshaft axis; and a template attached to a stationary portion of the engine, the template including a crank pin track into which the crank pin extends, the crank pin track movably capturing the crankpin such that the connecting rod/crank throw axis is guided through the path.

16. The engine of claim 15 wherein the mechanical linkage comprises:

a pair of crank throws extending from an opposing pair of crank shaft journals of the crankshaft, each crank throw having a slot disposed therein;

the crank pin being slidably captured by the slots such that the crank pin is oriented parallel to, but offset from, the crankshaft; and an opposing pair of templates, each with a crank pin track to moveably capture the crank pin and guide the connecting rod/crank throw axis through the path.

17. An engine comprising:

a crankshaft having a crank throw, the crank throw having a slot disposed therein, the crankshaft rotating about a crankshaft axis;

a compression piston slidably received within a compression cylinder and operatively connected to the crankshaft such that the compression piston reciprocates through an intake stroke and a compression stroke of a four stroke cycle during a single rotation of the crankshaft;

an expansion piston slidably received within an expansion cylinder;

a connecting rod pivotally connected to the expansion piston;

a crank pin rotationally connecting the crank throw to the connecting rod about a connecting rod/crank throw axis to allow the expansion piston to reciprocate through an expansion stroke and an exhaust stroke of the four stroke cycle during the same rotation of the crankshaft, the crank pin being slidably captured by the slot in the crank throw to allow radial movement of the crank pin relative to the crankshaft; and a template attached to a stationary portion of the engine, the template including a crank pin track into which the crank pin extends, the crank pin track movably capturing the crankpin such that the connecting rod/crank throw axis is guided through a path about the crankshaft axis.

18. The engine of claim 17 wherein the distance between the connecting rod/crank throw axis and the crankshaft axis at any point in the path defines an effective crank throw radius, and the path comprises a first transition region from a first effective crank throw radius to a second effective crank throw radius.

19. The engine of claim 18 wherein the first effective crank throw radius is smaller than the second effective crank throw radius.

20. The engine of claim 19 wherein the first transition region begins a predetermined number of degrees CA past top dead center.

* * * * *